US012005304B2

(12) United States Patent
Takeda et al.

(10) Patent No.: US 12,005,304 B2
(45) Date of Patent: Jun. 11, 2024

(54) PEDAL-DRIVEN EXERCISE MACHINE

(71) Applicant: TOYOTA JIDOSHA KABUSHIKI KAISHA, Toyota (JP)

(72) Inventors: Takahiro Takeda, Toyota (JP); Eisuke Aoki, Toyota (JP); Yuji Nakamura, Toyota (JP); Riyusei Takano, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/705,722

(22) Filed: Mar. 28, 2022

(65) Prior Publication Data

US 2022/0331653 A1 Oct. 20, 2022

(30) Foreign Application Priority Data

Apr. 14, 2021 (JP) ..... 2021-068357

(51) Int. Cl.
*A63B 22/06* (2006.01)
*A63B 22/20* (2006.01)
*A63B 71/00* (2006.01)

(52) U.S. Cl.
CPC ..... *A63B 22/0694* (2013.01); *A63B 22/20* (2013.01); *A63B 71/0036* (2013.01)

(58) Field of Classification Search
CPC ..... A63B 22/0605; A63B 22/0664; A63B 22/0694; A63B 22/20; A63B 22/201; A63B 22/203; A63B 2022/0611; A63B 2022/0623; A63B 2022/0629; A63B 2022/0635; A63B 2022/0652; A63B 2022/0676; A63B 2022/0682; A63B 71/0036
See application file for complete search history.

(56) References Cited

U.S. PATENT DOCUMENTS 5,299,995 A * 4/1994 Ko ..... A63B 23/0417 482/52
5,453,065 A * 9/1995 Lien ..... A63B 22/0056 482/52
7,901,331 B1 * 3/2011 Stoll ..... A63B 21/15 482/52
10,843,033 B1 * 11/2020 Sotis ..... A63B 23/0211
2002/0155927 A1 * 10/2002 Corbalis ..... A63B 22/0007 482/52
2007/0184937 A1 8/2007 Graber
2008/0146421 A1 * 6/2008 Hsieh ..... A63B 21/02 482/129
2018/0318639 A1 11/2018 Kim

FOREIGN PATENT DOCUMENTS

GB 2511321 A * 9/2014 ..... A63B 22/0605
JP H10-94577 A 4/1998
WO 2021/067258 A1 4/2021

* cited by examiner

*Primary Examiner* — Zachary T Moore
(74) *Attorney, Agent, or Firm* — Oliff PLC

(57) ABSTRACT

A pedal-driven exercise machine is designed for an exerciser in a seated position to do pedaling. The pedal-driven exercise machine is equipped with a main body portion, a crank unit that is rotatably supported by the main body portion, a pedal unit that is rotatably supported by the crank unit, and a foot space securing unit that secures a foot space at a foot of the exerciser by retreating the pedal unit from the foot of the exerciser when the pedal-driven exercise machine is out of use.

17 Claims, 21 Drawing Sheets

PEDAL-DRIVEN EXERCISE MACHINE

CROSS-REFERENCE TO RELATED APPLICATION

This application claims priority to Japanese Patent Application No. 2021-068357 filed on Apr. 14, 2021, incorporated herein by reference in its entirety.

BACKGROUND

1. Technical Field

The invention relates to a pedal-driven exercise machine.

2. Description of Related Art

Japanese Unexamined Patent Application Publication No. H10-94577 (JPH 10-94577 A) discloses an exercise machine for pedaling in a seated position.

SUMMARY

By the way, in order for those engaged in sedentary work to compensate for the lack of exercise, it is effective to do exercise through the use of a pedal-driven exercise machine under a desk during sedentary work. When the pedal-driven exercise machine is out of use, it is conceivable to pull out the pedal-driven exercise machine from under the desk and keep it in another place to secure a foot space.

However, it is bothersome to pull out the pedal-driven exercise machine from under the desk and move it every time the use thereof comes to an end, and the continuity of exercise is hampered.

It is an object of the invention to provide a pedal-driven exercise machine that does not cause an obstruction without the trouble of being moved.

From the standpoint of the invention of the present application, there is provided a pedal-driven exercise machine designed for an exerciser in a seated position to do pedaling. The pedal-driven exercise machine is equipped with a main body portion, a crank unit that is rotatably supported by the main body portion, a pedal unit that is rotatably supported by the crank unit, and a foot space securer that secures a space at a foot of the exerciser by retreating the pedal unit from the foot of the exerciser when the pedal-driven exercise machine is out of use. According to this configuration, the pedal-driven exercise machine that does not cause an obstruction when out of use is realized.

Preferably, the pedal unit has a toe-side region and a heel-side region that are different in position from each other in a foot length direction. The toe-side region is located closer to a toe side than the heel-side region in the foot length direction. The toe-side region of the pedal unit is coupled to the crank unit. The foot space securer includes a guide that prescribes a trajectory of the heel-side region when the pedal-driven exercise machine is in use, a guide supporter that supports the guide in such a manner as to allow a posture of the guide to be changed over between a first guide posture that is a posture in which the guide is tilted toward the exerciser side for use of the pedal-driven exercise machine, and a second guide posture that is a posture in which the guide has been pulled up when the pedal-driven exercise machine is out of use, and an out-of-use guide holder that holds the guide in the second guide posture. According to this configuration, the foot space securer that retreats the pedal unit from the foot of the exerciser is realized.

Preferably, the guide supporter supports the guide rotatably around a guide rotary shaft fixed in position with respect to the main body portion. According to this configuration, the posture of the guide can be easily changed over between the first guide posture and the second guide posture.

Preferably, the out-of-use guide holder holds the guide in the second guide posture by imparting frictional resistance to rotation of the guide. According to this configuration, the out-of-use guide holder is realized with a simple configuration.

Preferably, the foot space securer includes a torque-resistance hinge with two blades one of which is fixed to the guide and the other of which is fixed in position with respect to the main body portion, as the guide supporter and the out-of-use guide holder. According to this configuration, the guide supporter and the out-of-use guide holder are simultaneously realized with a simple configuration.

Preferably, the foot space securer includes a stay that is placed to bridge a gap between the guide and a member fixed in position with respect to the main body portion, at a position away from the guide rotary shaft, as the out-of-use guide holder. According to this configuration, the out-of-use guide holder is realized with a simple configuration.

Preferably, the guide supporter is an elastic plate that includes an upper plate that functions as the guide, and a lower plate fixed in position with respect to the main body portion, with the upper plate and the lower plate being coupled to each other via a fold. According to this configuration, the guide supporter is realized with a simple configuration.

Preferably, the elastic plate holds the guide in the second guide posture by an elastic restoring force of the elastic plate along the fold, as the out-of-use guide holder. According to this configuration, the out-of-use guide holder is realized with a simple configuration.

Preferably, the foot space securer further includes an in-use guide holder that holds the guide in the first guide posture. According to this configuration, the guide can be held in the first guide posture.

Preferably, the foot space securer includes a changeover switch that changes over the posture of the guide between the first guide posture and the second guide posture. According to this configuration, the posture of the guide can be easily changed over between the first guide posture and the second guide posture.

Preferably, the changeover switch includes a motor.

Preferably, the foot space securer further includes an elastic body that pushes up the guide. According to this configuration, the weights of the pedal unit and the guide can be partially or entirely counterbalanced, so it is easy to change over the posture of the guide from the first guide posture to the second guide posture.

Preferably, the foot space securer further includes a separation prohibition mechanism that prohibits the heel-side region from separating from the guide. According to this configuration, when the guide is made to assume the second guide posture, the pedal unit can be prohibited from separating from the guide.

Preferably, the foot space securer further includes a pull-up restrictor that prohibits the guide from being pulled up any further when the guide is made to assume the second guide posture. According to this configuration, the guide is prohibited from being pulled up too much, so the pedal unit can be prohibited from separating from the guide.

Preferably, the guide is provided with a handle. According to this configuration, the guide can be easily pulled up.

Preferably, the pedal-driven exercise machine is equipped with a pair of pedal units identical to the pedal unit, and a pair of foot space securers identical to the foot space securer. The foot space securers correspond to the pedal units respectively.

Preferably, the guide of each of the foot space securers is provided with a handle.

Preferably, the guides of the foot space securers are formed integrally with each other. According to this configuration, the guides of the foot space securers can be pulled up in a single action.

Preferably, the pedal unit has a toe-side region and a heel-side region that are different in position from each other in a foot length direction. The toe-side region is located closer to a toe side than the heel-side region in the foot length direction. The toe-side region of the pedal unit is coupled to the crank unit. A yaw-axis joint is provided as the foot space securer, in the vicinity of the toe-side region of the pedal unit. According to this configuration, the pedal-driven exercise machine that does not cause an obstruction when out of use is realized.

Preferably, the pedal unit has a toe-side region and a heel-side region that are different in position from each other in a foot length direction. The toe-side region is located closer to a toe side than the heel-side region in the foot length direction. The toe-side region of the pedal unit is coupled to the crank unit. The crank unit includes a rotary shaft that is rotatably supported by the main body portion, and a crank as the foot space securer that extends from the rotary shaft. The crank includes a first crank portion that is fixed to the rotary shaft, and a second crank portion that is able to rotate with respect to the first crank portion around an axis of rotation along a length direction of the crank and that is coupled to the pedal unit. According to this configuration, the pedal-driven exercise machine that does not cause an obstruction when out of use is realized.

According to the invention, the pedal-driven exercise machine that does not cause an obstruction when out of use is realized.

BRIEF DESCRIPTION OF THE DRAWINGS

Features, advantages, and technical and industrial significance of exemplary embodiments of the invention will be described below with reference to the accompanying drawings, in which like signs denote like elements, and wherein.

DETAILED DESCRIPTION OF EMBODIMENTS

The invention will be described hereinafter through the first to fourth embodiments. However, the invention mentioned in the claims should not be limited to the following embodiments. Besides, the configurations described in the embodiments are not entirely indispensable as a means for solving the problem. For the sake of clear explanation, the following description and drawings are omitted and simplified as appropriate. In the respective drawings, like elements are denoted by like reference symbols, and redundant description is omitted as needed.

First Embodiment

The first embodiment will be described hereinafter with reference to FIGS. 1 to 4.

Figure 1:
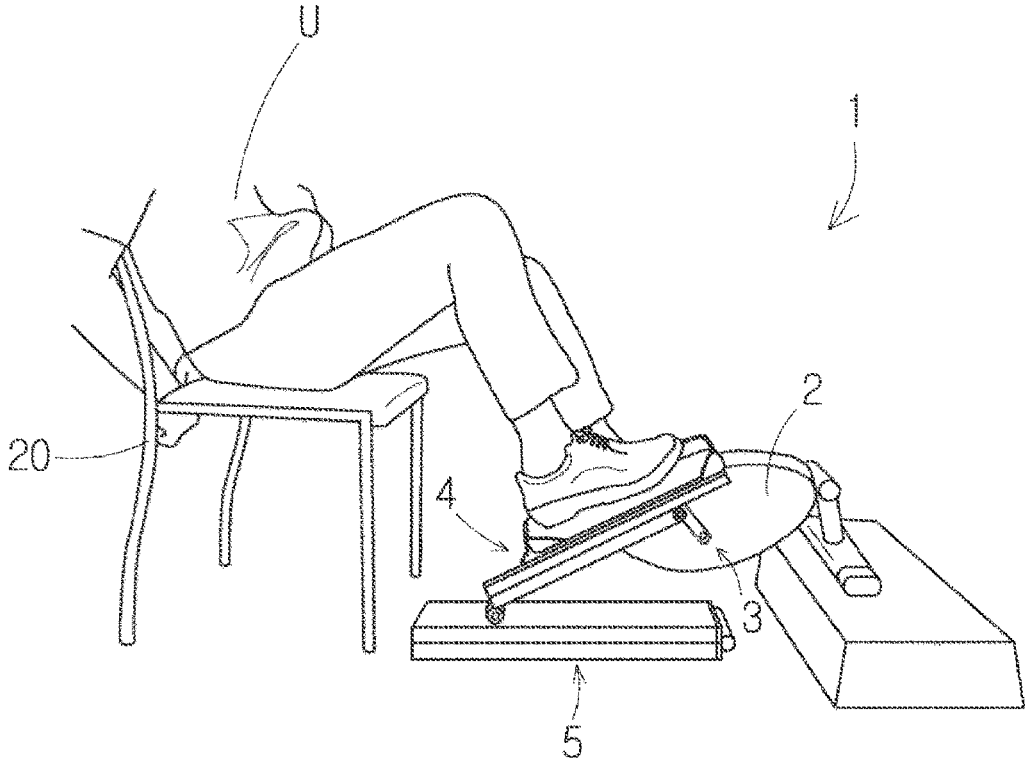
FIG. 1 is a perspective view of a pedal-driven exercise machine that is in use (first embodiment)

FIG. 1 shows a pedal-driven exercise machine 1 designed for an exerciser U in a seated position to do pedaling. As shown in FIG. 1, the pedal-driven exercise machine 1 includes a main body portion 2, a crank unit 3, two pedal units 4, and two foot space securing units 5. In FIG. 1, only the pedal unit 4 corresponding to the right leg of the exerciser U is depicted instead of the two pedal units 4. By the same token, in FIG. 1, only the foot space securing unit 5 corresponding to the right leg of the exerciser U is depicted instead of the two foot space securing units 5.

The main body portion 2 rotatably supports the crank unit 3 around a horizontal axis. The main body portion 2 is fixed in position with respect to a floor surface. Typically, a leg portion of the main body portion 2 is subjected to anti-slip finishing such that the main body portion 2 does not slip with respect to the floor surface when the pedal-driven exercise machine 1 is in use. The main body portion 2 is configured to be able to impart resistance to rotation of the crank unit 3. The horizontal axis, namely, an axis parallel to an axis of rotation of the crank unit 3 will be referred to hereinafter as a pitch axis.

Figure 2:
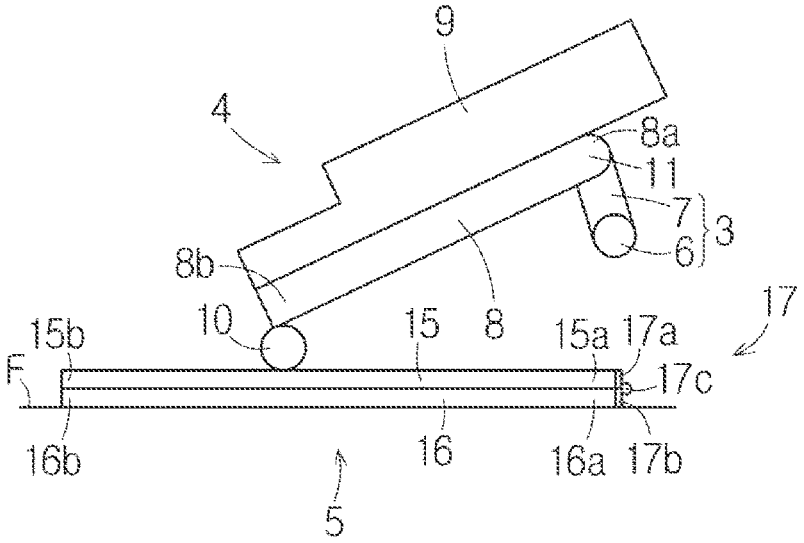
FIG. 2 is a partially enlarged lateral view of the pedal-driven exercise machine that is in use (first embodiment)
Figure 3:
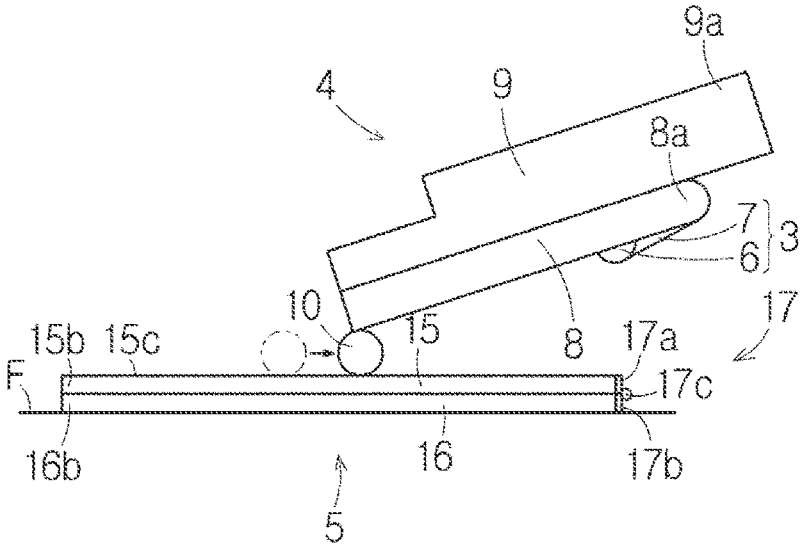
FIG. 3 is a partially enlarged lateral view of the pedal-driven exercise machine that is in use (first embodiment)
Figure 4:
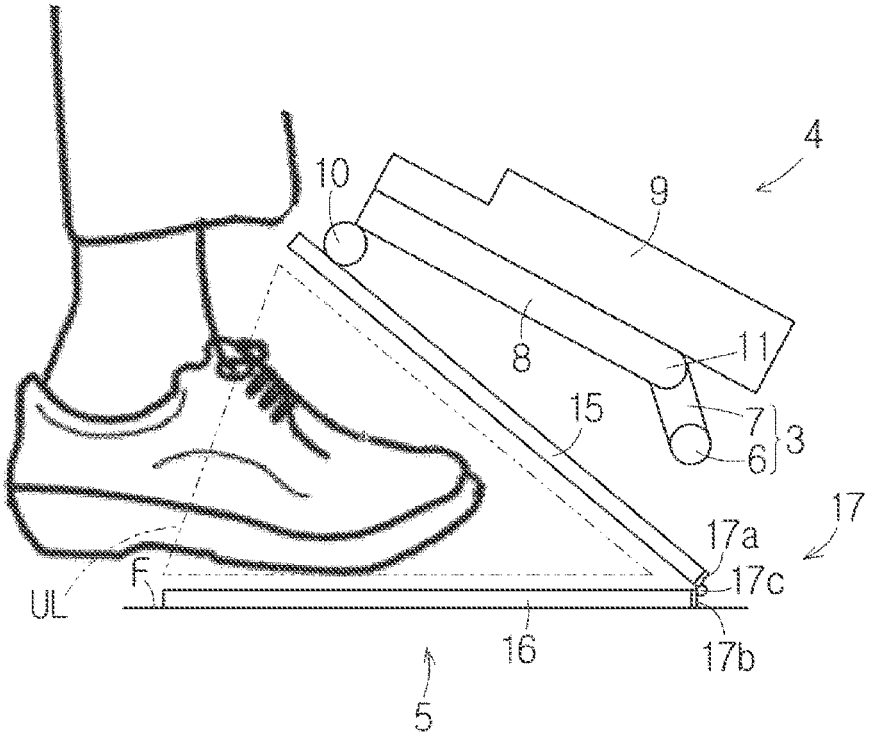
FIG. 4 is a partially enlarged lateral view of the pedal-driven exercise machine that is out of use (first embodiment)

In FIGS. 2 to 4, the main body portion 2 is not depicted. As shown in FIG. 2, the crank unit 3 includes a rotary shaft 6 that extends along the axis of rotation of the crank unit 3, and two cranks 7 that extend from both ends of the rotary shaft 6 respectively. The rotary shaft 6 is supported by a bearing (not shown) of the main body portion 2. FIG. 2 shows only the crank 7 corresponding to the right leg of the exerciser U instead of the two cranks 7. The two cranks 7 extend perpendicularly to the length direction of the rotary shaft 6. The two cranks 7 extend from the rotary shaft 6 in opposite directions.

The two pedal units 4 are rotatably supported by the crank unit 3 around the pitch axis. In concrete terms, the two pedal units 4 are supported by the two cranks 7 of the crank unit 3 rotatably around the pitch axis, respectively. In the present embodiment, the two pedal units 4 are identical in configuration. Therefore, only the pedal unit 4 corresponding to the right leg of the exerciser U will be described, and the description of the other pedal unit 4 will be omitted.

The pedal unit 4 corresponding to the right leg of the exerciser U includes a link 8, a pedal 9, and a sliding wheel 10.

The link 8 is formed in such a manner as to extend along a foot length direction of the foot of the exerciser U. The link 8 has a toe-side region 8*a* and a heel-side region 8*b* that are different in position from each other in the foot length direction.

The toe-side region 8*a* is located closer to the toe side than the heel-side region 8*b* in the foot length direction. That is, the heel-side region 8*b* is located closer to the heel side than the toe-side region 8*a* in the foot length direction. The toe-side region 8*a* of the link 8 is coupled to the crank 7 rotatably around the pitch axis. A coupling shaft that couples the link 8 and the crank 7 to each other will be referred to hereinafter as a toe-side coupling shaft 11 as well.

The heel-side region 8*b* is provided with the sliding wheel 10 rotatably around the pitch axis. It should be noted, however, that the sliding wheel 10 can be dispensed with.

The pedal 9 is a region on which the foot of the exerciser U is placed, and is arranged on the link 8. The pedal 9 may be arranged on the link 8 in such a manner as to be able to slide with respect to the link 8 within a predetermined range in the foot length direction, or may be arranged on the link 8 in such a manner as to be unable to slide with respect to the link 8 in the foot length direction.

The foot space securing unit 5 is a concrete example of the foot space securer for securing a space at the foot of the exerciser U by retreating the pedal unit 4 from the foot of the exerciser U when the pedal-driven exercise machine 1 is out of use. The foot space securing unit 5 includes an upper plate 15, a lower plate 16, and a hinge 17.

Both the upper plate 15 and the lower plate 16 are thin plates extending in a longitudinal direction. The longitudinal direction is a direction prescribed based on the orientation of the line of sight of the exerciser U. When the pedal-driven exercise machine 1 is in use, both the upper plate 15 and the lower plate 16 are arranged such that the thickness direction thereof coincides with a vertical direction. When the pedal-driven exercise machine 1 is in use, the upper plate 15 and the lower plate 16 are superimposed on each other in the vertical direction. When the pedal-driven exercise machine 1 is in use, the upper plate 15 is arranged on the lower plate 16 as viewed in the vertical direction. The upper plate 15 has a front end 15*a* and a rear end 15*b*. The lower plate 16 has a front end 16*a* and a rear end 16*b*.

The hinge 17 has an upper blade 17*a*, a lower blade 17*b*, and a coupling portion 17*c*. The upper blade 17*a* and the lower blade 17*b* are coupled to each other via the coupling portion 17*c* relatively rotatably around the pitch axis. The upper blade 17*a* is fixed to the front end 15*a* of the upper plate 15. The lower blade 17*b* is fixed to the front end 16*a* of the lower plate 16. Thus, the upper plate 15 and the lower plate 16 can rotate relatively to each other around the pitch axis via the hinge 17. That is, the upper plate 15 can rotate relatively to the lower plate 16 around the pitch axis via the hinge 17.

Besides, in the present embodiment, the lower plate 16 is fixed to a floor surface F on which the pedal-driven exercise machine 1 is installed, by a drill screw (not shown). The lower plate 16 may be fixed to the main body portion 2 fixed in position with respect to the floor surface F. That is, a configuration for coupling the lower plate 16 to the main body portion 2 relatively immovably is conceivable. Thus, the coupling portion 17*c* is fixed in position relatively to the main body portion 2. That is, the hinge 17 supports the upper plate 15 rotatably around the coupling portion 17*c* (the guide rotary shaft) fixed in position with respect to the main body portion 2. Accordingly, the hinge 17 is a concrete example of the guide supporter. Besides, the hinge 17 of the present embodiment is a torque-resistance hinge that imparts frictional resistance to rotation of the upper plate 15 relative to the lower plate 16, and allows the upper plate 15 to rotate relatively to the lower plate 16 only when a torque equal to or larger than a predetermined value is applied to the hinge 17.

As shown in FIG. 3, the upper plate 15 is a guide that prescribes the trajectory of the heel-side region 8*b* of the link 8 of the pedal unit 4 when the pedal-driven exercise machine 1 is in use. That is, when the crank unit 3 supported by the main body portion 2 rotates, the toe-side region 8*a* of the link 8 draws a circular trajectory around the rotary shaft 6 of the crank unit 3. In contrast, the heel-side region 8*b* of the link 8 moves in a reciprocating manner in the longitudinal direction along an upper surface 15*c* of the upper plate 15. In concrete terms, the sliding wheel 10 provided on the heel-side region 8*b* of the link 8 rolls on the upper surface 15*c* of the upper plate 15. In this manner, the toe-side region 8*a* of the link 8 draws a circular trajectory, and the heel-side region 8*b* of the link 8 draws a straight trajectory. Thus, a tip portion 9*a* of the pedal 9 of the pedal unit 4 typically draws an elliptical trajectory.

As shown in FIG. 3, the upper surface 15*c* of the upper plate 15 extends straight in the longitudinal direction. Therefore, the trajectory of the heel-side region 8*b* of the link 8 of the pedal unit 4 also extends straight in the longitudinal direction when the pedal-driven exercise machine 1 is in use. Instead, however, the upper surface 15*c* of the upper plate 15 may be inclined, for example, in such a manner as to approach the floor surface F with increases in distance to the front side. By changing the shape of the upper surface 15*c* of the upper plate 15, the range of use of the joint angle of an ankle joint (an ankle region) can be adjusted when the pedal-driven exercise machine 1 is in use.

Returning to FIG. 1, the exerciser U does pedaling through the use of the pedal-driven exercise machine 1 in a seated position. Accordingly, when the exerciser U does exercise through the use of the pedal-driven exercise machine 1, a chair 20 on which the exerciser U is seated is utilized as shown in FIG. 1. The chair 20 may be integrated with the pedal-driven exercise machine 1, or may be separated from the pedal-driven exercise machine 1.

FIG. 4 shows the pedal-driven exercise machine 1 that is out of use. As shown in FIG. 4, when the pedal-driven exercise machine 1 is out of use, the upper plate 15 has been pulled up. That is, the posture of the upper plate 15 can be changed over between a first guide posture that is a posture in which the upper plate 15 is tilted toward the exerciser U for the use of the pedal-driven exercise machine 1 as shown in FIG. 3, and a second guide posture that is a posture in which the upper plate 15 has been pulled up when the pedal-driven exercise machine 1 is out of use as shown in FIG. 4. That is, the posture of the upper plate 15 can be changed over between the first guide posture of FIG. 3 and the second guide posture of FIG. 4, through the support of the upper plate 15 by the lower plate 16 via the hinge 17.

As shown in FIG. 4, when the posture of the upper plate 15 is changed over to the second guide posture, the pedal unit 4 is flipped up, namely, retreated upward from the foot of the exerciser U. In this case, the crank unit 3 does not rotate, the toe-side coupling shaft 11 does not move either, and the pedal unit 4 is flipped up while rotating around the toe-side coupling shaft 11. Thus, a foot space UL for the exerciser U is secured between the pedal unit 4 and the floor surface F. In the present embodiment, the foot space UL is a triangular space between the pulled-up upper plate 15 and the lower plate 16 in a lateral view. In this manner, the foot space UL for the exerciser U is secured when the pedal-driven exercise machine 1 is out of use. Thus, the exerciser U can concentrate on his or her sedentary work with his or her lower legs relaxed.

The first embodiment, which has been described above, has the following features.

As shown in FIGS. 1 to 4, the pedal-driven exercise machine 1 is designed for the exerciser U in a seated position to do pedaling. The pedal-driven exercise machine 1 is equipped with the main body portion 2, the crank unit 3 that is rotatably supported by the main body portion 2, the pedal units 4 that are rotatably supported by the crank unit 3, and the foot space securing units 5 (the foot space securer) that secure the foot space UL (the space) at the feet of the exerciser U by retreating the pedal units 4 from the feet of the exerciser U when the pedal-driven exercise machine 1 is out of use. According to this configuration, the pedal-driven exercise machine 1 that does not cause an obstruction without the trouble of being moved is realized.

Besides, the pedal unit 4 has the toe-side region 8*a* and the heel-side region 8*b* that are different in position from each other in the foot length direction. The toe-side region 8*a* is located closer to the toe-side than the heel-side region 8*b* in the foot length direction. The toe-side region 8*a* of the pedal unit 4 is coupled to the crank unit 3. The foot space securing unit 5 includes the upper plate 15 (the guide) and the hinge 17 (the guide supporter, the out-of-use guide holder). The upper plate 15 is a guide that prescribes the trajectory of the heel-side region 8*b* when the pedal-driven exercise machine 1 is in use. The hinge 17 supports the upper plate 15 in such a manner as to be able to change over the posture of the upper plate 15 between the first guide posture and the second guide posture. In the first guide posture, the upper plate 15 is tilted toward the exerciser U side for the use of the pedal-driven exercise machine 1. In the second guide posture, the upper plate 15 has been pulled up when the pedal-driven exercise machine 1 is out of use. The hinge 17 holds the upper plate 15 in the second guide posture. According to this configuration, the foot space securing units 5 that retreat the pedal units 4 from the feet of the exerciser U respectively are realized with a simple configuration.

Besides, the hinge 17 (the guide supporter) supports the upper plate 15 rotatably around the coupling portion 17*c* (the guide rotary shaft) fixed in position with respect to the main body portion 2. According to this configuration, the posture of the upper plate 15 can be easily changed over between the first guide posture and the second guide posture.

Besides, the hinge 17 holds the upper plate 15 in the second guide posture by imparting frictional resistance to rotation of the upper plate 15. According to this configuration, the out-of-use guide holder is realized with a simple configuration.

Besides, the foot space securing unit 5 includes the hinge 17 as the guide supporter and the out-of-use guide holder. The hinge 17 is a torque-resistance hinge having the upper blade 17*a* (one of the blades) fixed to the upper plate 15 and the lower blade 17*b* (the other blade) fixed in position with respect to the main body portion 2. According to this configuration, frictional resistance can be imparted to rotation of the upper plate 15 with a simple configuration.

Incidentally, in the present embodiment, the lower blade 17*b* (the other blade) of the hinge 17 is fixed in position relatively to the main body portion 2 by being fixed to the lower plate 16 fixed in position relatively to the main body portion 2. Instead, however, the lower blade 17*b* of the hinge 17 may be directly fixed to the main body portion 2. That is, the lower plate 16 can be dispensed with. Any means is applicable as long as the rotary shaft of the upper plate 15 is fixed in position relatively to the main body portion 2.

First Modification Example

Next, a first modification example of the first embodiment will be described with reference to FIG. 5. The difference between the present modification example and the first embodiment will be described mainly, and redundant description will be omitted.

In the first embodiment, the holding of the upper plate 15 in the second guide posture is realized by adopting the torque-resistance hinge as the hinge 17 that couples the upper plate 15 and the lower plate 16 to each other as shown in, for example, FIG. 4.

Figure 5:
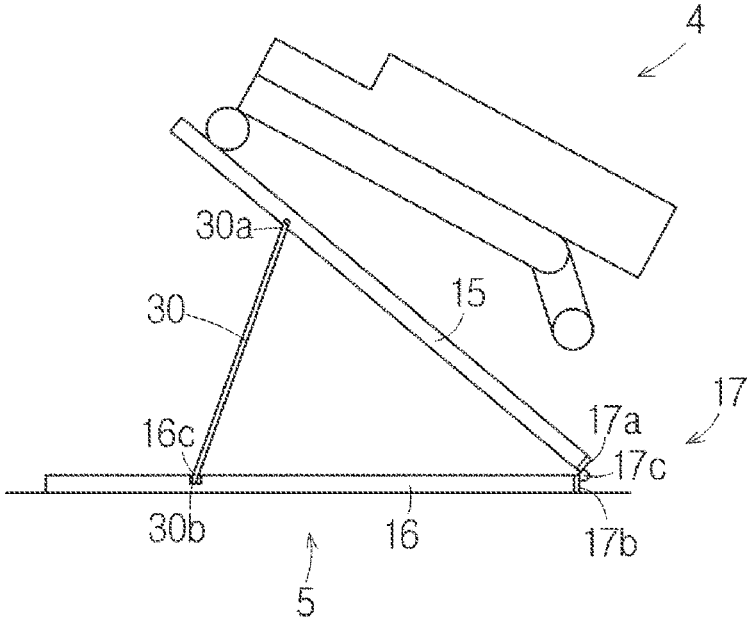
FIG. 5 is a partially enlarged lateral view of a pedal-driven exercise machine that is out of use (first modification example)

In contrast, as shown in FIG. 5, the foot space securing unit 5 uses a stay 30 to hold the upper plate 15 in the second guide posture in the present modification example. The stay 30 is a concrete example of the out-of-use guide holder. The stay 30 is placed to bridge a gap between the upper plate 15 and the lower plate 16, at a position away from the coupling portion 17*c* (the guide rotary shaft) of the hinge 17, with the upper plate 15 in the second guide posture. The lower plate 16 is a concrete example of the member fixed in position with respect to the main body portion 2. An upper end 30*a* of the stay 30 is typically attached irremovably to the upper plate 15. Besides, the stay 30 is rockably attached to the upper plate 15. A lower end 30*b* of the stay 30 can be inserted into and extracted from a recess 16*c* provided in the lower plate 16. In this configuration, when the lower end 30*b* of the stay 30 is extracted from the recess 16*c*, the upper plate 15 can be tilted toward the exerciser U side and held in the first guide posture. Besides, the upper plate 15 can be held in the second guide posture, by inserting the lower end 30*b* of the stay 30 into the recess 16*c* of the lower plate 16 with the upper plate 15 in the second guide posture.

As described above, in the present modification example, the foot space securing unit 5 (the foot space securer) includes the stay 30 that is placed to bridge the gap between the upper plate 15 and the lower plate 16 (the member fixed in position with respect to the main body portion 2) at a position away from the coupling portion 17*c* (the guide rotary shaft), as the out-of-use guide holder. According to this configuration, the out-of-use guide holder is realized with a simple configuration.

Incidentally, the lower end 30*b* of the stay 30 may be irremovably attached to the lower plate 16, and the upper end 30*a* of the stay 30 may be insertable into and extractable from the recess provided in the upper plate 15.

Second Modification Example

Next, a second modification example of the first embodiment will be described with reference to FIG. 6. The difference between the present modification example and the first embodiment will be described mainly, and redundant description will be omitted.

In the first embodiment, the range of the angle by which the upper plate 15 can rotate is not limited in particular, as shown in FIG. 4. Accordingly, when the upper plate 15 is pulled up too much, the center of gravity of the pedal unit 4 crosses the toe-side coupling shaft 11, and the pedal unit 4 starts rotating in such a manner as to move away from the upper plate 15 due to the weight of the pedal unit 4.

Figure 6:
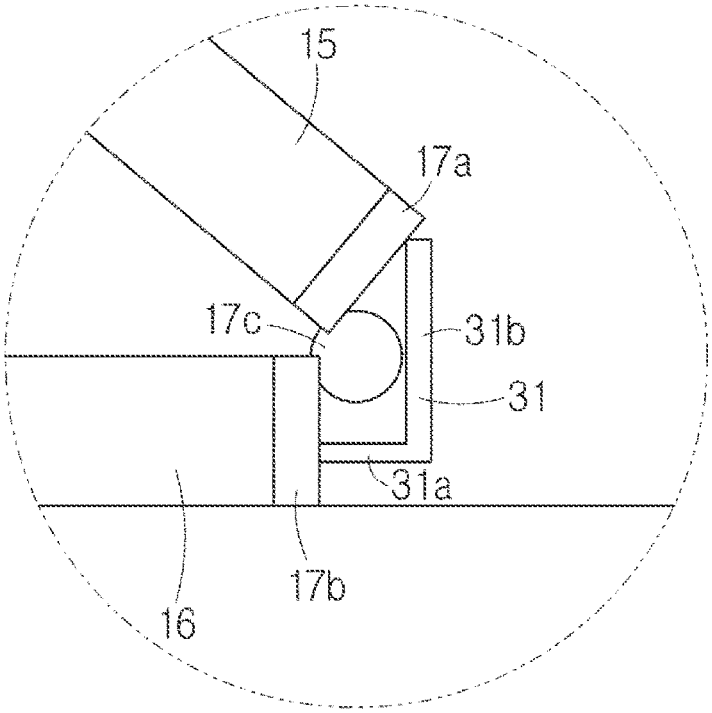
FIG. 6 is a partially enlarged lateral view of a pedal-driven exercise machine that is out of use (second modification example)

Thus, in the present modification example, the foot space securing unit 5 further includes an L-shaped stopper 31 that prohibits the upper plate 15 from being pulled up any further when the upper plate 15 is made to assume the second guide posture, as shown in FIG. 6. The L-shaped stopper 31 is a concrete example of the pull-up restrictor.

The L-shaped stopper 31 typically includes a horizontal portion 31*a* that protrudes forward from the lower blade 17*b*, and a vertical portion 31*b* that protrudes upward from the horizontal portion 31*a*. Then, when an attempt is made to further pull up the upper plate 15 with the upper plate 15 in the second guide posture, the upper blade 17*a* comes into contact with the vertical portion 31*b*, so the upper plate 15 is prohibited from being pulled up any further. The L-shaped stopper 31 typically prohibits the upper plate 15 from rotating by 90° or more from the position thereof in the first guide posture. The L-shaped stopper 31 preferably prohibits the upper plate 15 from rotating by 50° or more from the position thereof in the first guide posture. The L-shaped stopper 31 prohibits the upper plate 15 from rotating too much, so as to prevent the center of gravity of the pedal unit 4 from crossing the toe-side coupling shaft 11, regardless of the angular position of the crank 7.

As described hitherto, the foot space securing unit 5 further includes the L-shaped stopper 31 (the pull-up restrictor) that prohibits the upper plate 15 from being pulled up any further when the upper plate 15 is made to assume the second guide posture. According to this configuration, the upper plate 15 is prohibited from being pulled up too much, so the pedal unit 4 can be prohibited from separating from the upper plate 15.

Third Modification Example

Next, a third modification example of the first embodiment will be described with reference to FIG. 7. The difference between the present modification example and the first embodiment will be described mainly, and redundant description will be omitted.

In the first embodiment, the range of the angle by which the upper plate 15 can rotate is not limited in particular, as shown in FIG. 4. Accordingly, when the upper plate 15 is pulled up too much, the center of gravity of the pedal unit 4 crosses the toe-side coupling shaft 11, and the pedal unit 4 starts rotating in such a manner as to move asway from the upper plate 15 due to the weight of the pedal unit 4.

Figure 7:
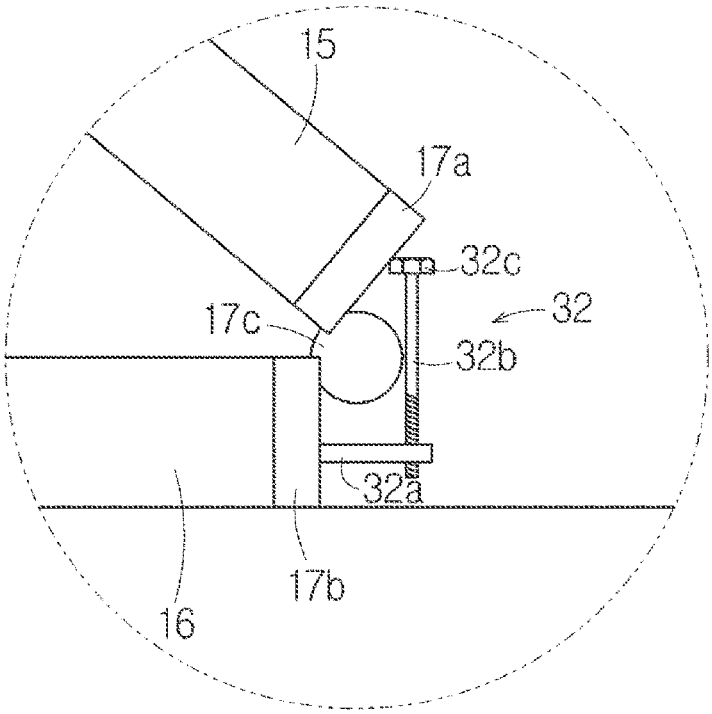
FIG. 7 is a partially enlarged lateral view of a pedal-driven exercise machine that is out of use (third modification example)

Thus, in the present modification example, the foot space securing unit 5 further includes a screw stopper 32 that prohibits the upper plate 15 from being pulled up any further when the upper plate 15 is made to assume the second guide posture, as shown in FIG. 7. The screw stopper 32 is a concrete example of the pull-up restrictor.

The screw stopper 32 typically includes a horizontal portion 32*a* that protrudes forward from the lower blade 17*b*, and a bolt 32*b* that is screwed in an internal thread (not shown) of the horizontal portion 32*a*. Then, when an attempt is made to further pull up the upper plate 15 with the upper plate 15 in the second guide posture, the upper blade 17*a* comes into contact with a head 32*c* of the bolt 32*b*, so the upper plate 15 is prohibited from being pulled up any further. The screw stopper 32 typically prohibits the upper plate 15 from rotating by 90° or more from the position thereof in the first guide posture. The screw stopper 32 preferably prohibits the upper plate 15 from rotating by 50° or more from the position thereof in the first guide posture. The screw stopper 32 prohibits the upper plate 15 from rotating too much, so as to prevent the center of gravity of the pedal unit 4 from crossing the toe-side coupling shaft 11, regardless of the angular position of the crank 7.

As described hitherto, the foot space securing unit 5 further includes the screw stopper 32 (the pull-up restrictor) that prohibits the upper plate 15 from being pulled up any further when the upper plate 15 is made to assume the second guide posture. According to this configuration, the upper plate 15 is prohibited from being pulled up too much, so the pedal unit 4 can be prohibited from separating from the upper plate 15.

Fourth Modification Example

Next, a fourth modification example of the first embodiment will be described with reference to FIG. 8. The difference between the present modification example and the first embodiment will be described mainly, and redundant description will be omitted.

In the first embodiment, the range of the angle by which the upper plate 15 can rotate is not limited, as shown in FIG. 4. Accordingly, when the upper plate 15 is pulled up too much, the center of gravity of the pedal unit 4 crosses the toe-side coupling shaft 11, and the pedal unit 4 starts rotating in such a manner as to move away from the upper plate 15 due to the weight of the pedal unit 4.

Figure 8:
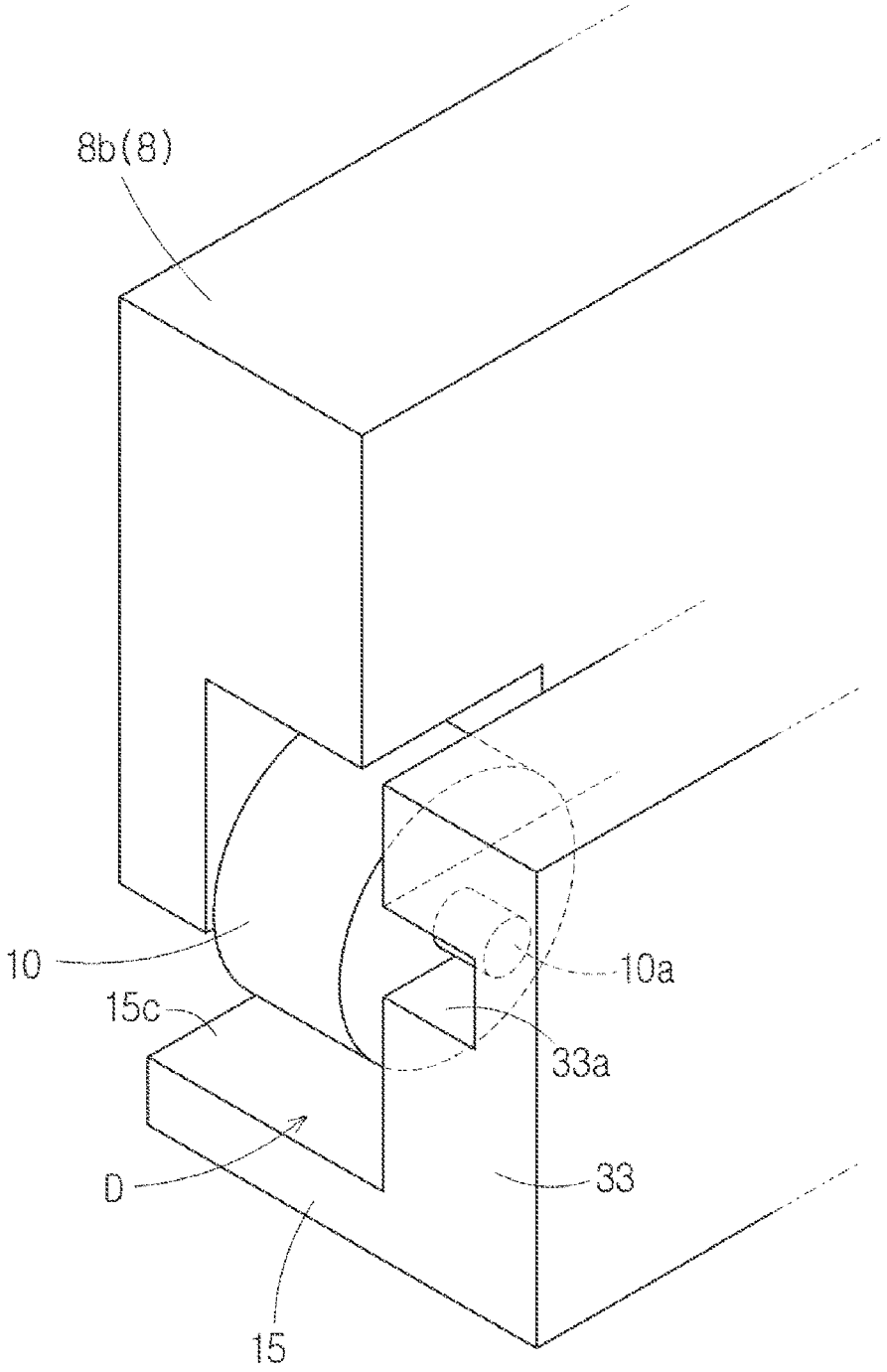
FIG. 8 is a partially enlarged perspective view of a pedal-driven exercise machine (fourth modification example)

Thus, in the present modification example, the foot space securing unit 5 further includes a separation prohibition mechanism D that prohibits the heel-side region 8*b* of the link 8 from separating from the upper plate 15, as shown in FIG. 8. In the present modification example, the separation prohibition mechanism D includes a rotary shaft 10*a* as an extension of the sliding wheel 10 provided on the heel-side region 8*b* of the link 8, and a separation prohibition portion 33 having an accommodation groove 33*a* in which the rotary shaft 10*a* is accommodated. The separation prohibition portion 33 protrudes upward from the upper surface 15*c* of the upper plate 15, and extends along the length direction of the upper plate 15. The accommodation groove 33*a* extends in the length direction of the separation prohibition portion 33, and is formed in such a manner as to open toward the sliding wheel 10. Then, when the heel-side region 8*b* of the link 8 moves along the upper surface 15*c* of the upper plate 15, the rotary shaft 10*a* of the sliding wheel 10 is always accommodated in the accommodation groove 33*a* of the separation prohibition portion 33. According to this configuration, no matter how much the upper plate 15 is pulled up, the pedal unit 4 can be prohibited from separating from the upper plate 15.

Fifth Modification Example

Next, a fifth modification example of the first embodiment will be described with reference to FIG. 9. The difference between the present modification example and the first embodiment will be described mainly, and redundant description will be omitted.

Figure 9:
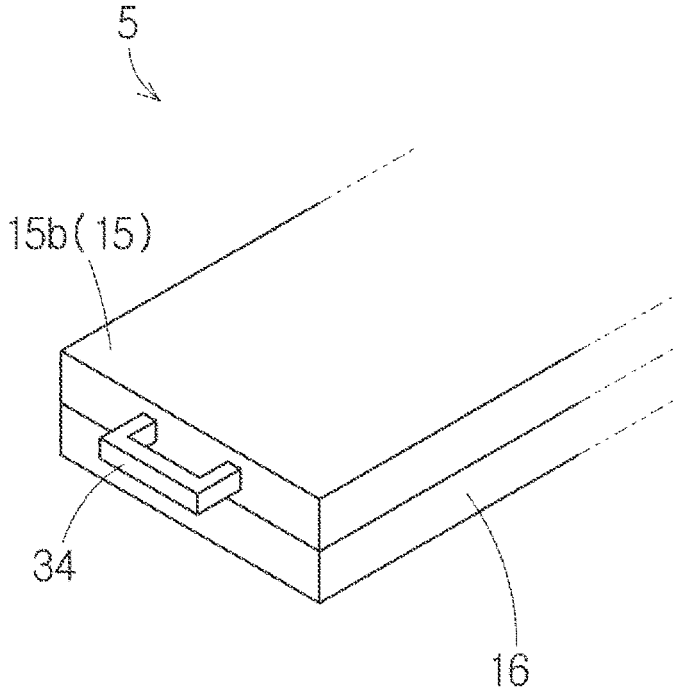
FIG. 9 is a partially enlarged perspective view of a pedal-driven exercise machine that is in use (fifth modification example)

As shown in FIG. 9, in the present modification example, a handle 34 is provided at the rear end 15*b* of the upper plate 15. The handle 34 protrudes backward from the rear end 15*b* of the upper plate 15. The handle 34 is typically formed in the shape of the letter U that opens forward. According to this configuration, the effort needed to pull up the upper plate 15 is reduced.

Incidentally, the exerciser U may grip the handle 34 with his or her hand to pull up the upper plate 15, or may kick up the handle 34 with his or her foot to pull up the upper plate 15.

Sixth Embodiment

Next, a sixth modification example of the first embodiment will be described with reference to FIG. 10. The difference between the present modification example and the first embodiment will be described mainly, and redundant description will be omitted.

As described with reference to FIG. 1, the pedal-driven exercise machine 1 includes the two pedal units 4. One of the pedal units 4 corresponds to the right leg of the exerciser U. The other pedal unit 4 corresponds to the left leg of the exerciser U.

The pedal-driven exercise machine 1 includes the two foot space securing units 5. One of the foot space securing units 5 corresponds to one of the pedal units 4. The other foot space securing unit 5 corresponds to the other pedal unit 4.

That is, the pedal-driven exercise machine 1 is equipped with a pair of the pedal units 4 and a pair of the foot space securing units 5. The foot space securing units 5 correspond to the pedal units 4 respectively.

Moreover, the handle 34 is provided at the rear end 15*b* of the upper plate 15 of each of the foot space securing units 5. The handle 34 protrudes backward from the rear end 15*b* of the upper plate 15. The handle 34 is typically formed in the shape of the letter U that opens forward. According to this configuration, the effort needed to pull up the upper plate 15 is reduced.

Incidentally, the exerciser U may grip the handle 34 with his or her hand to pull up the upper plate 15, or may kick up the handle 34 with his or her foot to pull up the upper plate 15.

Figure 10:
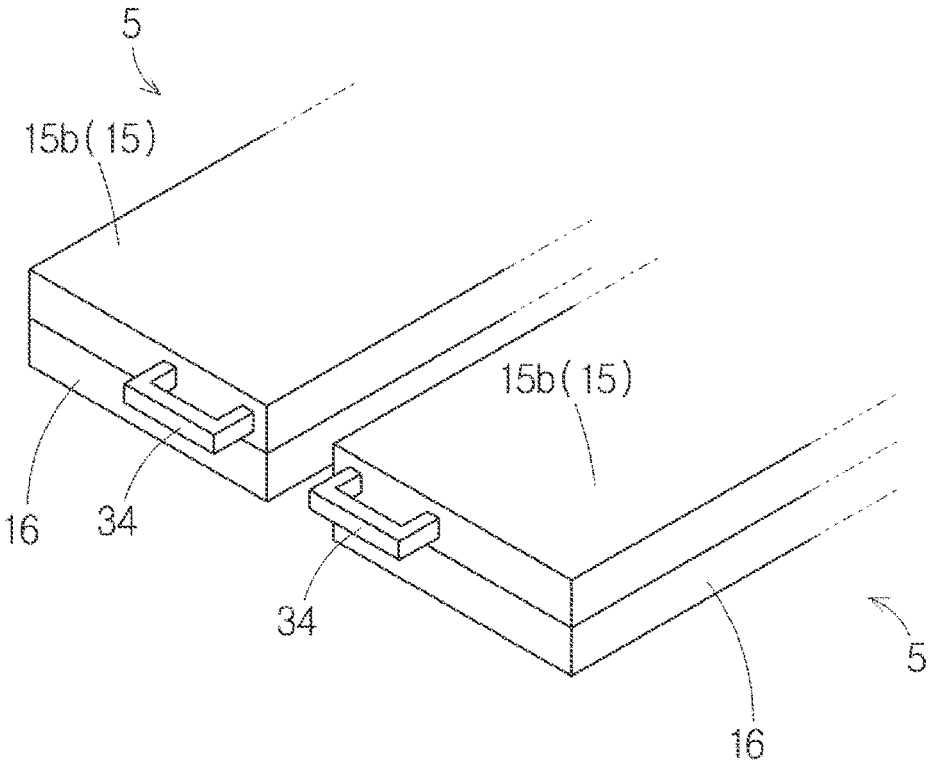
FIG. 10 is a partially enlarged perspective view of a pedal-driven exercise machine that is in use (sixth modification example)

As shown in FIG. 10, the handle 34 provided at the rear end 15*b* of one of the upper plates 15 is arranged close to the other upper plate 15. By the same token, the handle 34 provided at the rear end 15*b* of the other upper plate 15 is arranged close to the one of the upper plates 15. In short, the two handles 34 are arranged as close as possible to each other. According to this configuration, the exerciser U can simultaneously grip the two handles 34 with his or her hands to pull up the two upper plates 15 at the same time. Alternatively, the exerciser U can simultaneously kick up the two handles 34 with his or her feet to pull up the two upper plates 15 at the same time.

Seventh Modification Example

Figure 11:
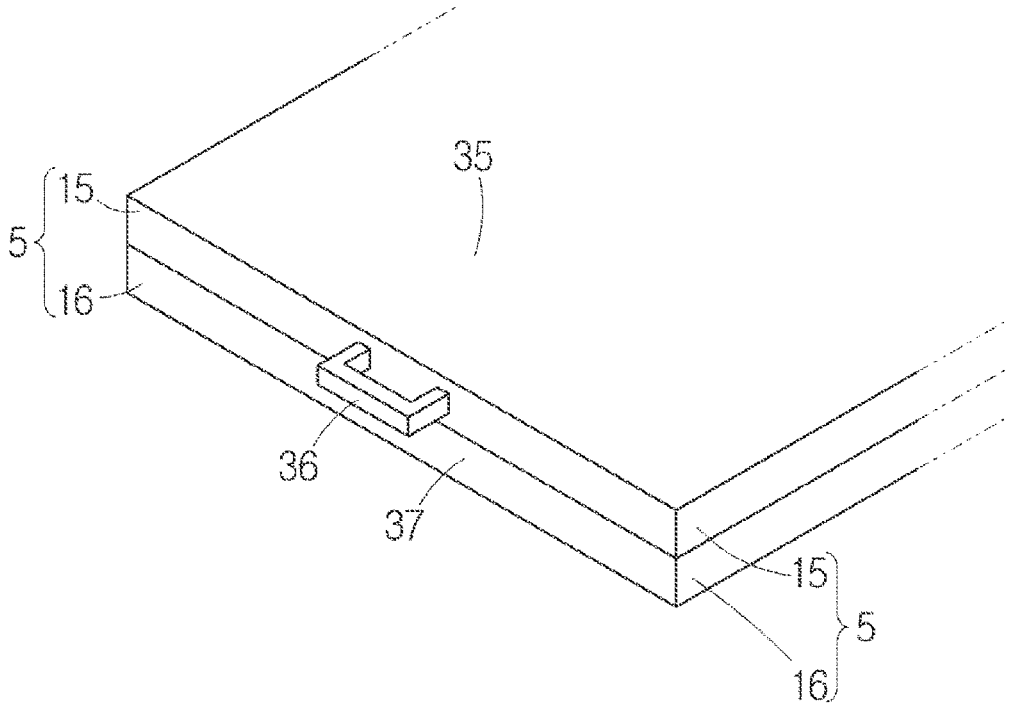
FIG. 11 is a partially enlarged perspective view of a pedal-driven exercise machine that is in use (seventh modification example)

Next, a seventh modification example of the first embodiment will be described with reference to FIG. 11. The difference between the present modification example and the first embodiment will be described mainly, and redundant description will be omitted.

As described with reference to FIG. 1, the pedal-driven exercise machine 1 includes the two pedal units 4. One of the pedal units 4 corresponds to the right leg of the exerciser U. The other pedal unit 4 corresponds to the left leg of the exerciser U.

The pedal-driven exercise machine 1 includes the two foot space securing units 5. One of the foot space securing units 5 corresponds to one of the pedal units 4. The other foot space securing unit 5 corresponds to the other pedal unit 4.

That is, the pedal-driven exercise machine 1 is equipped with a pair of the pedal units 4 and a pair of the foot space securing units 5. The foot space securing units 5 correspond to the pedal units 4 respectively.

Moreover, in the present modification example, the two foot space securing units 5 are integrated with each other. That is, the upper plate 15 belonging to one of the foot space securing units 5 and the upper plate 15 belonging to the other foot space securing unit 5 are formed integrally with each other. According to this configuration, the upper plates 15 of the two foot space securing units 5 can be pulled up at the same time.

By being integrated with each other, the two upper plates 15 constitute an upper plate unit 35. As shown in FIG. 11, the upper plate unit 35 may be provided with a handle 36.

Incidentally, as is the case with the upper plates 15, the lower plate 16 belonging to one of the foot space securing units 5 and the lower plate 16 belonging to the other foot space securing unit 5 are formed integrally with each other in the present modification example. By being integrated with each other, the two lower plates 16 constitute a lower plate unit 37.

Eighth Modification Example

Next, an eighth modification example of the first embodiment will be described with reference to FIG. 12. The difference between the present modification example and the first embodiment will be described mainly, and redundant description will be omitted.

Figure 12:
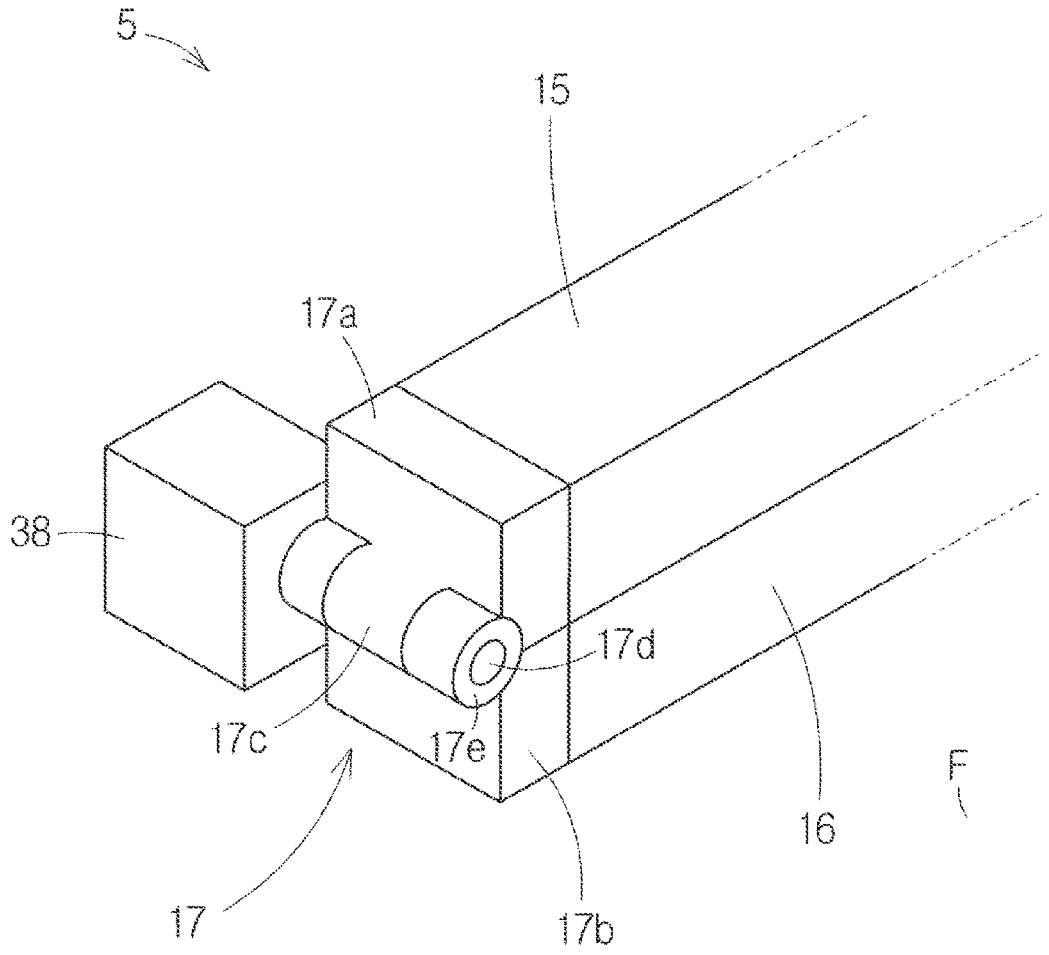
FIG. 12 is a partially enlarged perspective view of a pedal-driven exercise machine that is in use (eighth modification example)

As shown in FIG. 12, the foot space securing unit 5 is equipped with a motor 38 that changes over the posture of the upper plate 15 between the first guide posture and the second guide posture in the present modification example. The motor 38 is a concrete example of the changeover switch.

In concrete terms, the coupling portion 17*c* of the hinge 17 includes a shaft 17*d* fixed to the upper blade 17*a*, and a bearing 17*e* fixed to the lower blade 17*b*. An output shaft of the motor 38 is coupled to the bearing 17*d* via a joint (not shown) and a reducer (not shown). A stator of the motor 38 is fixed in position relatively to the main body portion 2. The stator of the motor 38 is typically fixed to the floor surface F or the lower plate 16. Owing to this configuration, the motor 38 can positively change over the posture of the upper plate 15 between the first guide posture and the second guide posture by applying a desired torque to the shaft 17*d*. Accordingly, the exerciser U can control the posture of the upper plate 15 via a controller for controlling the motor 38 by, for example, providing the controller on a desk.

Incidentally, as the out-of-use guide holder for holding the upper plate 15 in the second guide posture, it is conceivable to utilize a holding torque of the motor 38 in the case where the motor 38 is a stepping motor, and to provide, for example, an electromagnetic brake on the output shaft of the motor 38, etc. in addition to the adoption of the torque-resistance hinge as the hinge 17 as described previously.

Ninth Modification Example

Next, a ninth modification example of the first embodiment will be described with reference to FIGS. 13 and 14. The difference between the present modification example and the first embodiment will be described mainly, and redundant description will be omitted.

The present modification example is similar to the eighth modification example in that the foot space securing unit 5 is equipped with the motor 38 as the changeover switch.

Figure 13:
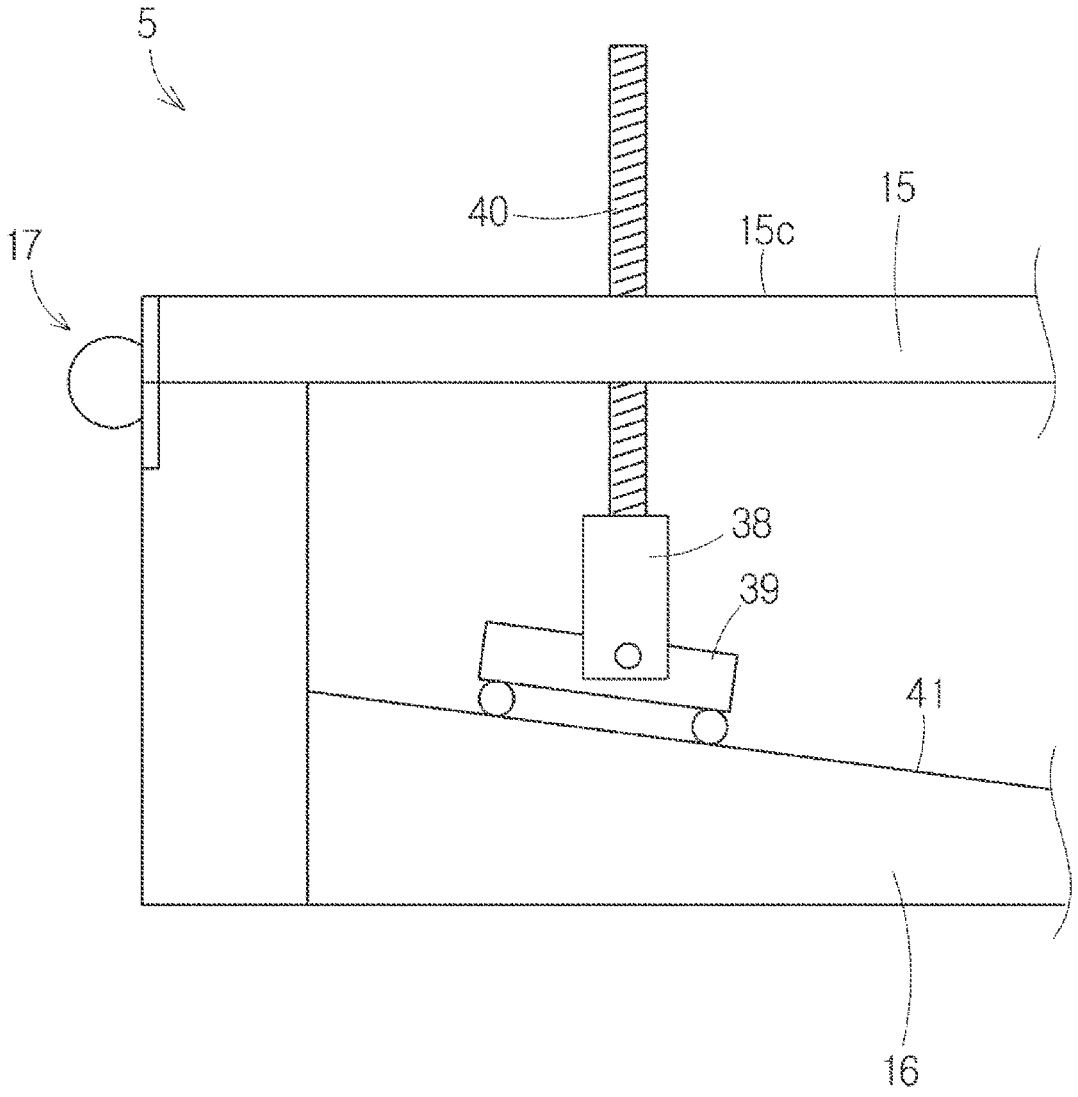
FIG. 13 is a partially enlarged lateral view of a pedal-driven exercise machine that is in use (ninth modification example)

In concrete terms, the foot space securing unit 5 is equipped with the motor 38, a dolly 39, and a ball screw 40 in the present modification example, as shown in FIG. 13.

An inclined surface 41 that becomes lower with increases in distance from the hinge 17 is formed as part of the lower plate 16.

The dolly 39 supports the motor 38 rotatably around the pitch axis. The dolly 39 is configured to be able to run on the inclined surface 41.

The motor 38 rotationally drives the ball screw 40.

The ball screw 40 is engaged with the upper plate 15 in such a manner as to extend perpendicularly to the upper surface 15*c* of the upper plate 15.

Figure 14:
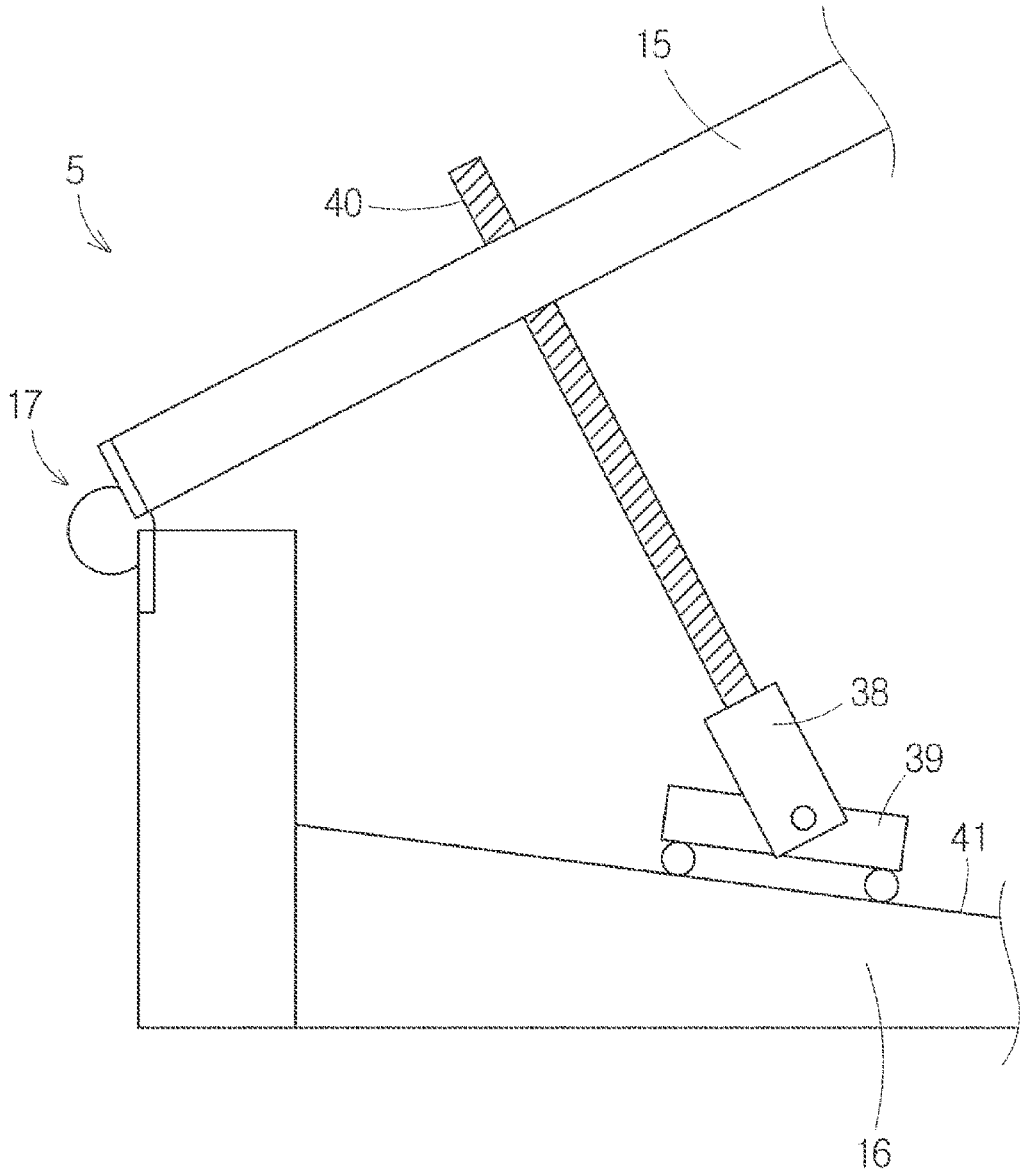
FIG. 14 is a partially enlarged lateral view of the pedal-driven exercise machine that is out of use (ninth modification example)

When the motor 38 rotates the ball screw 40 with the upper plate 15 in the first guide posture as shown in FIG. 13, the upper plate 15 is pulled up away from the dolly 39 while the dolly 39 moves away from the hinge 17 along the inclined surface 41 of the lower plate 16 as shown in FIG. 14. Owing to this configuration, the exerciser U can control the posture of the upper plate 15 via a controller for controlling the motor 38 by, for example, providing the controller on a desk.

Incidentally, as the out-of-use guide holder for holding the upper plate 15 in the second guide posture, it is conceivable to utilize a holding torque of the motor 38 in the case where the motor 38 is a stepping motor, and to provide the ball screw 40 with, for example, an electromagnetic brake, etc. in addition to the adoption of the torque-resistance hinge as the hinge 17 as described previously.

Tenth Modification Example

Next, a tenth modification example of the first embodiment will be described with reference to FIGS. 15 and 16. The difference between the present modification example and the first embodiment will be described mainly, and redundant description will be omitted.

The present modification example is similar to the eighth modification example in that the foot space securing unit 5 is equipped with the motor 38 as the changeover switch.

Figure 15:
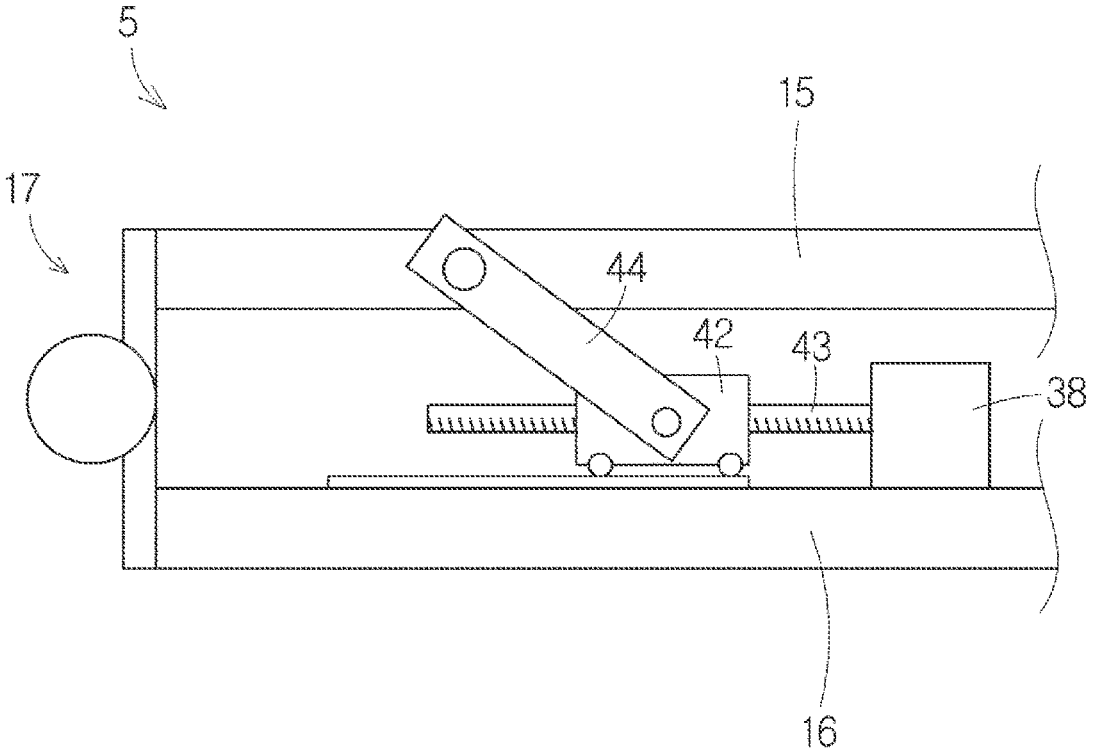
FIG. 15 is a partially enlarged lateral view of a pedal-driven exercise machine that is in use (tenth modification example)

In concrete terms, as shown in FIG. 15, the foot space securing unit 5 is equipped with the motor 38, a dolly 42, a ball screw 43, and an opening/closing link 44 in the present modification example.

The dolly 42 is configured to be able to run along the lower plate 16.

The motor 38 is fixed to the lower plate 16. The motor 38 rotationally drives the ball screw 43. The ball screw 43 extends along the length direction of the lower plate 16. The ball screw 43 is engaged with the dolly 42.

One end of the opening/closing link 44 is rotatably supported by the dolly 42 around the pitch axis. The other end of the opening/closing link 44 is rotatably supported by the upper plate 15 around the pitch axis.

Figure 16:
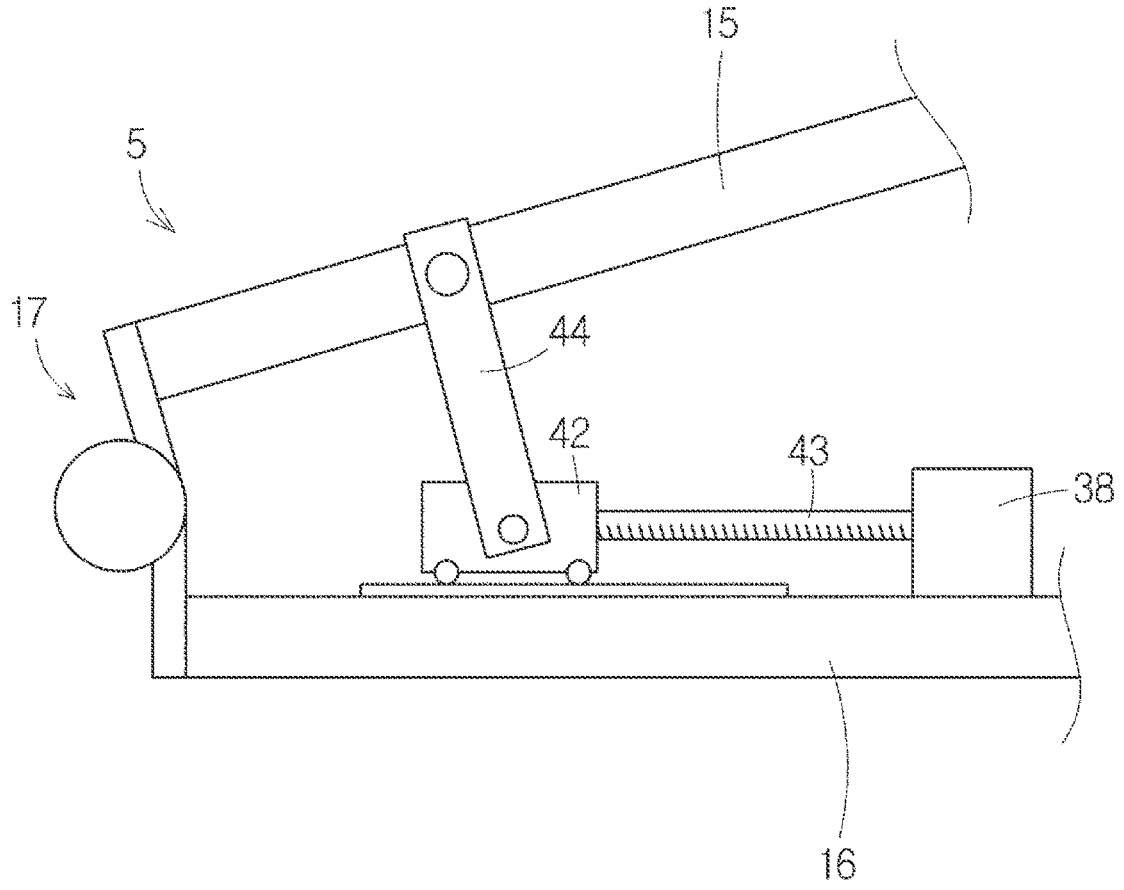
FIG. 16 is a partially enlarged lateral view of the pedal-driven exercise machine that is out of use (tenth modification example)

When the motor 38 rotates the ball screw 43 with the upper plate 15 in the first guide posture as shown in FIG. 15, the upper plate 15 is pulled up away from the lower plate 16 while the dolly 42 moves toward the hinge 17 along the lower plate 16 as shown in FIG. 16. Owing to this configuration, the exerciser U can control the posture of the upper plate 15 via a controller for controlling the motor 38 by, for example, providing the controller on a desk.

Incidentally, as the out-of-use guide holder for holding the upper plate 15 in the second guide posture, it is conceivable to utilize a holding torque of the motor 38 in the case where the motor 38 is a stepping motor, and to provide the ball screw 43 with, for example, an electromagnetic brake, etc. in addition to the adoption of the torque-resistance hinge as the hinge 17 as described previously.

Eleventh Modification Example

Next, an eleventh modification example of the first embodiment will be described with reference to FIG. 17. The difference between the present modification example and the first embodiment will be described mainly, and redundant description will be omitted.

Figure 17:
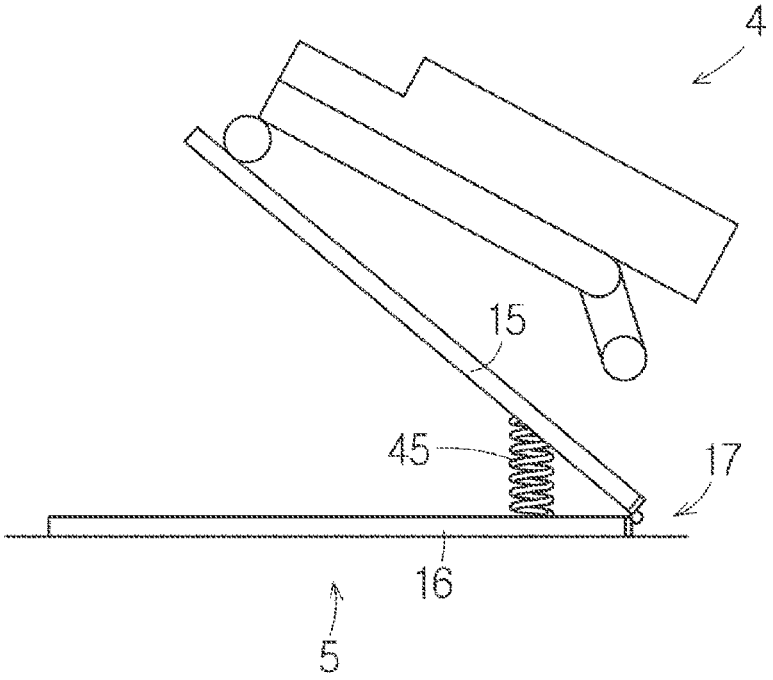
FIG. 17 is a partially enlarged lateral view of a pedal-driven exercise machine that is out of use (eleventh modification example)

As shown in FIG. 17, in the present modification example, the foot space securing unit 5 further includes an elastic body 45 that pushes up the upper plate 15 such that the posture of the upper plate 15 approaches the second guide posture. The elastic body 45 is typically a compression coil spring arranged between the upper plate 15 and the lower plate 16. Instead, however, the elastic body 45 may be a torsion coil spring provided on the hinge 17. According to this configuration, the weights of the pedal unit 4 and the upper plate 15 can be partially or entirely counterbalanced, so the load in changing over the posture of the upper plate 15 from the first guide posture to the second guide posture can be reduced.

Twelfth Modification Example

Next, a twelfth modification example of the first embodiment will be described with reference to FIG. 18. The difference between the present modification example and the first embodiment will be described mainly, and redundant description will be omitted.

In the first embodiment, the upper plate 15 and the lower plate 16 are coupled to each other by the hinge 17 as shown in, for example, FIG. 2.

Figure 18:
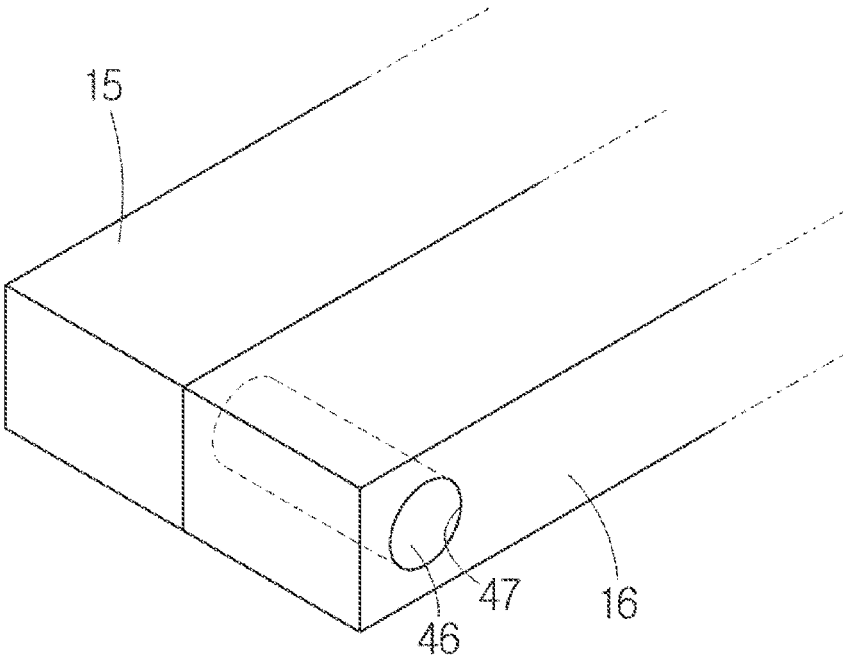
FIG. 18 is a partially enlarged perspective view of a pedal-driven exercise machine that is in use (twelfth modification example)

On the other hand, in the present modification example, the upper plate 15 is coupled to the lower plate 16 rotatably with respect to the lower plate 16 around the pitch axis, through the insertion of a shaft 46 that protrudes from the upper plate 15 in the direction of the pitch axis into a bearing 47 provided in the lower plate 16, as shown in FIG. 18. According to this configuration, no hinge is needed. Therefore, this configuration contributes towards reducing the number of parts of the foot space securing unit 5.

Second Embodiment

Next, the second embodiment will be described with reference to FIGS. 19 and 20. The difference between the present embodiment and the first embodiment will be described mainly, and redundant description will be omitted.

In the first embodiment, the upper plate 15 and the lower plate 16 are coupled to each other by the hinge 17 as shown in, for example, FIG. 2.

Figure 19:
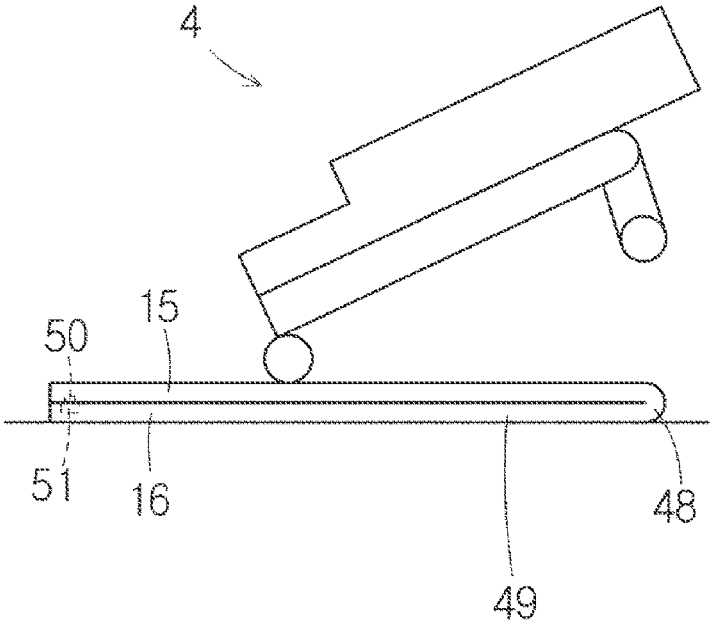
FIG. 19 is a partially enlarged lateral view of a pedal-driven exercise machine that is in use (second embodiment)

On the other hand, in the present embodiment, the foot space securing unit 5 is equipped with an elastic plate 49 that includes the upper plate 15 and the lower plate 16, with the upper plate 15 and the lower plate 16 coupled to each other via a fold 48, as shown in FIG. 19. That is, the foot space securing unit 5 is equipped with the elastic plate 49. The elastic plate 49 includes the upper plate 15 and the lower plate 16.

The elastic plate 49 is typically a leaf spring or a rubber plate. The fold 48 is formed in the elastic plate 49 by bending the elastic plate 49 around the pitch axis. The elastic plate 49 is a concrete example of the guide supporter.

Figure 20:
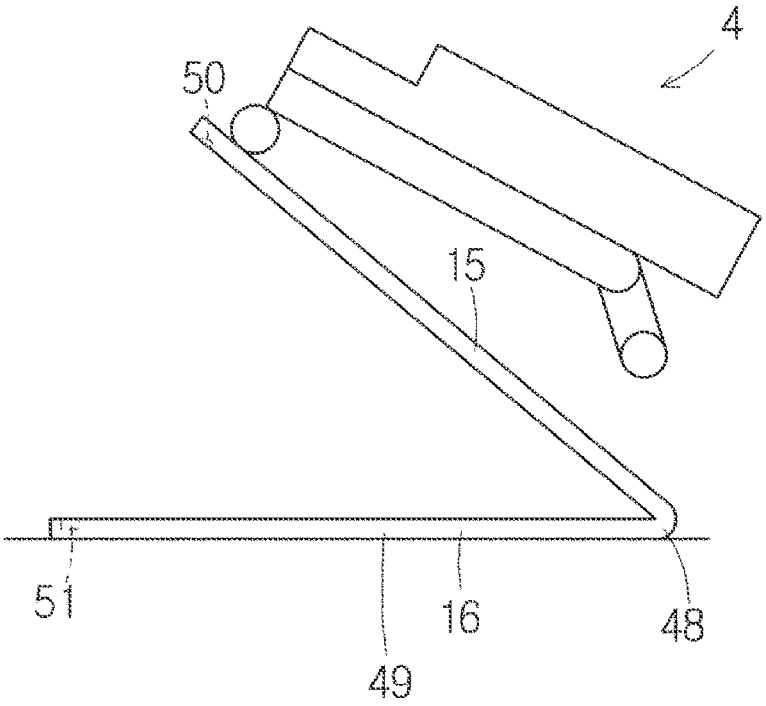
FIG. 20 is a partially enlarged lateral view of the pedal-driven exercise machine that is out of use (second embodiment)

As shown in FIG. 20, the elastic plate 49 holds the upper plate 15 in the second guide posture by an elastic restoring force of the elastic plate 49 along the fold 48.

Besides, as shown in FIG. 19, the upper plate 15 is provided with an upper magnet 50, and the lower plate 16 is provided with a lower magnet 51. When the upper plate 15 is made to assume the first guide posture, the upper magnet 50 and the lower magnet 51 are magnetically coupled to each other, and hence the upper plate 15 is held in the first guide posture. Accordingly, the upper magnet 50 and the lower magnet 51 are concrete examples of the in-use guide holder.

As described above, the second embodiment has the following features.

The foot space securing unit 5 includes the elastic plate 49 that includes the upper plate 15 (the guide) and the lower plate 16 fixed in position with respect to the main body portion 2, with the upper plate 15 and the lower plate 16 coupled to each other via the fold 48, as the guide supporter. According to this configuration, the guide supporter is realized with a simple configuration.

Besides, the elastic plate 49 holds the upper plate 15 in the second guide posture by an elastic restoring force of the elastic plate 49 along the fold 48, as the out-of-use guide holder. According to this configuration, the out-of-use guide holder is realized with a simple configuration.

Besides, the foot space securing unit 5 further includes the upper magnet 50 (the in-use guide holder) and the lower magnet 51 (the in-use guide holder) that hold the upper plate 15 in the first guide posture. According to this configuration, the upper plate 15 can be held in the first guide posture.

Incidentally, any one of a clamp, a hook, and a surface fastener or a combination thereof may be adopted as the in-use guide holder, instead of magnetic coupling by the exemplified magnets.

Besides, the first to twelfth modification examples of the first embodiment are applicable to the present embodiment as well as the first embodiment.

Third Embodiment

Next, the third embodiment will be described with reference to FIGS. 21 and 22. The difference between the present embodiment and the first embodiment will be described mainly, and redundant description will be omitted.

In the first embodiment, the pedal-driven exercise machine 1 is equipped with the foot space securing units 5 as the foot space securer. Each of the foot space securing units 5 includes the upper plate 15, the lower plate 16, and the hinge 17. Moreover, the space at the foot of the exerciser U is secured by flipping up the upper plate 15.

Figure 21:
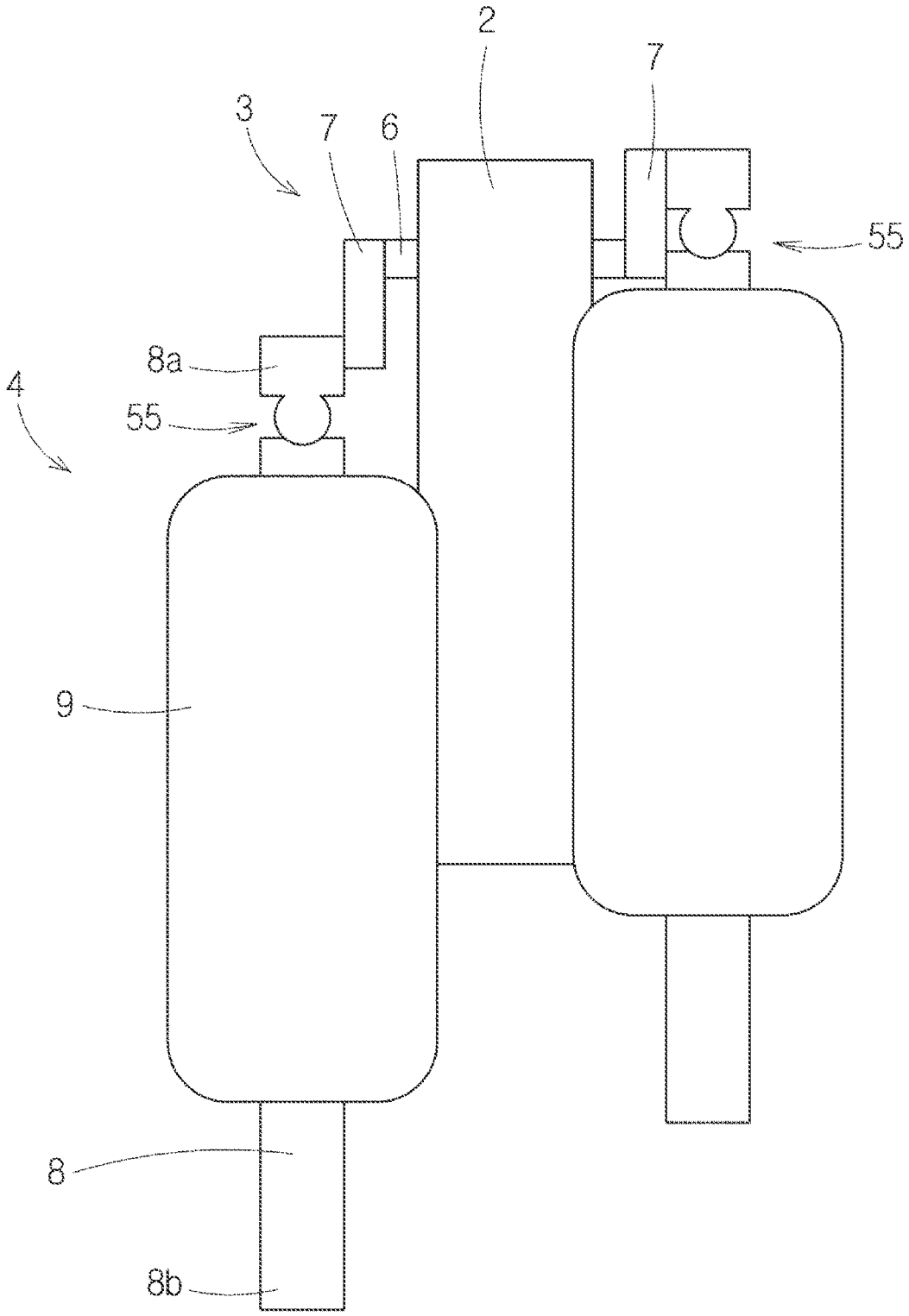
FIG. 21 is a plan view of a pedal-driven exercise machine that is in use (third embodiment)
Figure 22:
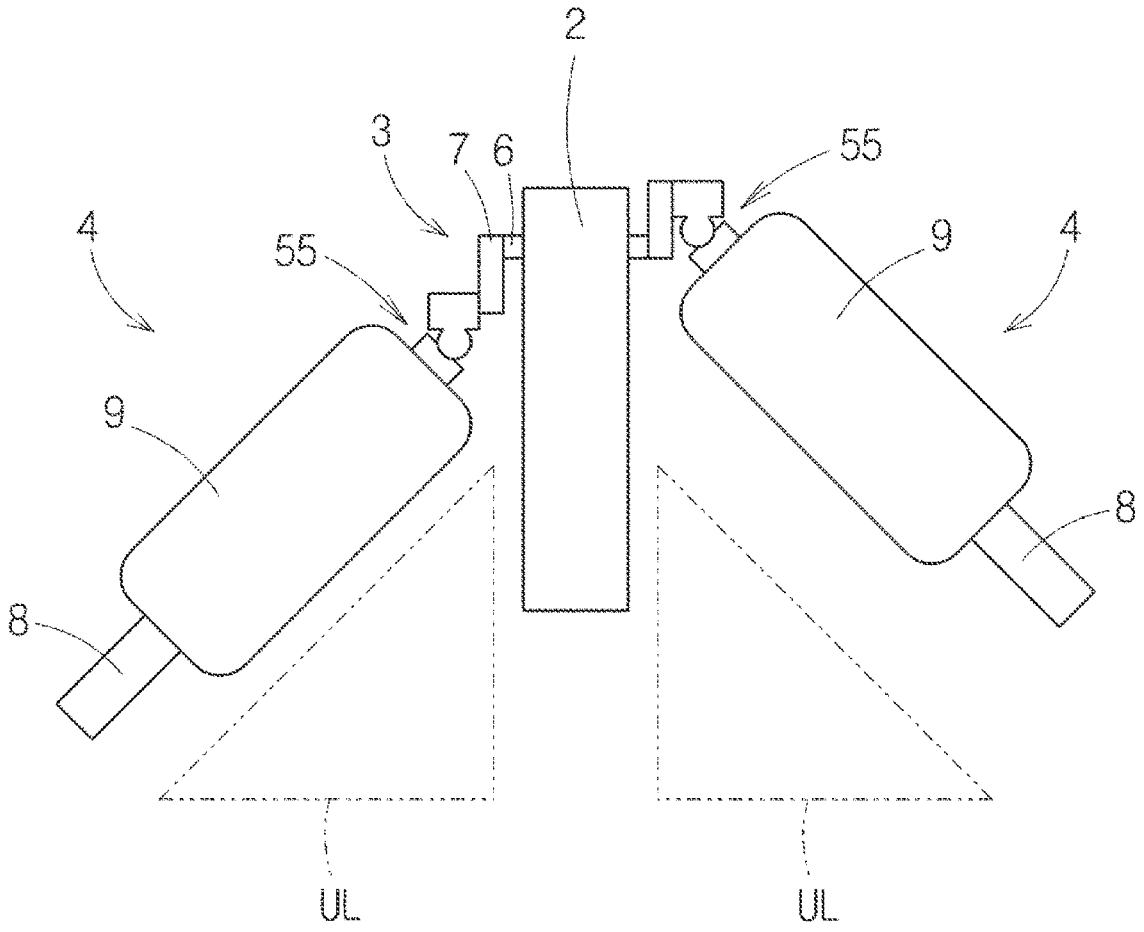
FIG. 22 is a plan view of the pedal-driven exercise machine that is out of use (third embodiment)

On the other hand, in the present embodiment, the pedal-driven exercise machine 1 is equipped with a yaw-axis joint 55 as the foot space securer, as shown in FIG. 21. The yaw-axis joint 55 is provided on the link 8 of the pedal unit 4. The yaw-axis joint 55 is provided in the vicinity of the toe-side region 8*a* of the link 8 of the pedal unit 4. The yaw-axis joint 55 is provided between the toe-side region 8*a* of the link 8 and the pedal 9. The yaw-axis joint 55 may be provided on the toe-side region 8*a* of the link 8. Due to the provision of the yaw-axis joint 55 on the link 8, the pedal unit 4 can be distanced from the main body portion 2 and hence retreated from the foot of the exerciser U by being rotated around the yaw-axis joint 55 when the pedal-driven exercise machine 1 is out of use, as shown in FIG. 22. Accordingly, the pedal-driven exercise machine 1 that does not cause an obstruction when out of use is realized.

Incidentally, the yaw-axis joint 55 may be provided with a plunger that holds the pedal unit 4 in position around the yaw axis. The plunger holds the pedal unit 4 in such a manner as to be able to make a changeover between the orientation of the pedal unit 4 at the time when the pedal-driven exercise machine 1 is in use and the orientation of the pedal unit 4 at the time when the pedal-driven exercise machine 1 is out of use.

Fourth Embodiment

Next, the fourth embodiment will be described with reference to FIGS. 23 to 26. The difference between the present embodiment and the first embodiment will be described mainly, and redundant description will be omitted.

In the first embodiment, the pedal-driven exercise machine 1 is equipped with the foot space securing units 5 as the foot space securer. Each of the foot space securing units 5 includes the upper plate 15, the lower plate 16, and the hinge 17. Moreover, the space at the foot of the exerciser U is secured by flipping up the upper plate 15.

Figure 23:
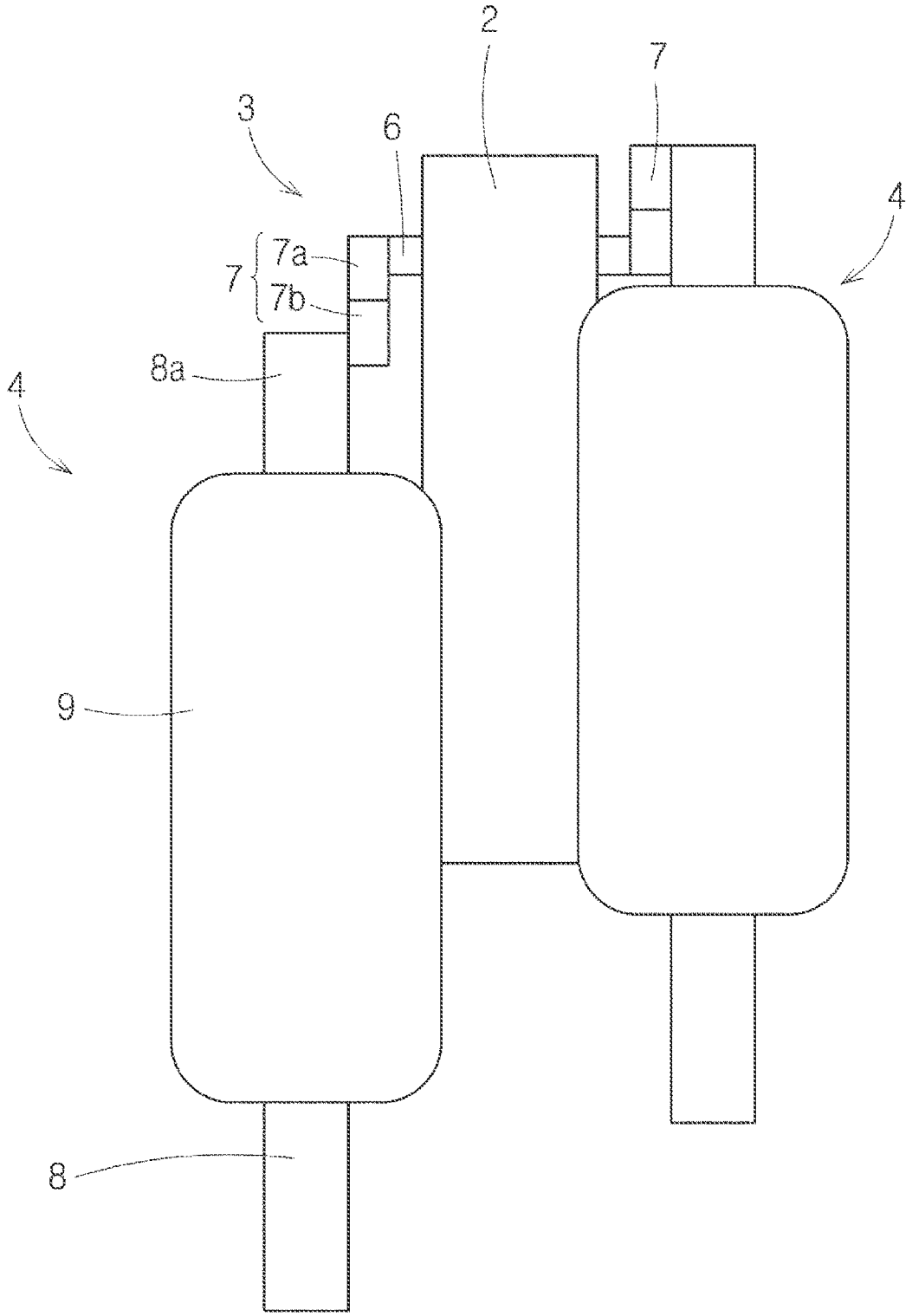
FIG. 23 is a plan view of a pedal-driven exercise machine that is in use (fourth embodiment)

On the other hand, in the present embodiment, each of the cranks 7 of the crank unit 3 functions as the foot space securer. That is, as shown in FIG. 23, each of the cranks 7 includes a first crank portion 7*a* that is fixed to the rotary shaft 6, and a second crank portion 7*b* that can rotate with respect to the first crank portion 7*a* around an axis of rotation along the length direction of the crank 7. The second crank portion 7*b* is coupled to the corresponding one of the pedal units 4. That is, the toe-side region 8*a* of the link 8 of the pedal unit 4 is coupled to the second crank portion 7*b* of the crank 7 rotatably around the pitch axis.

Figure 24:
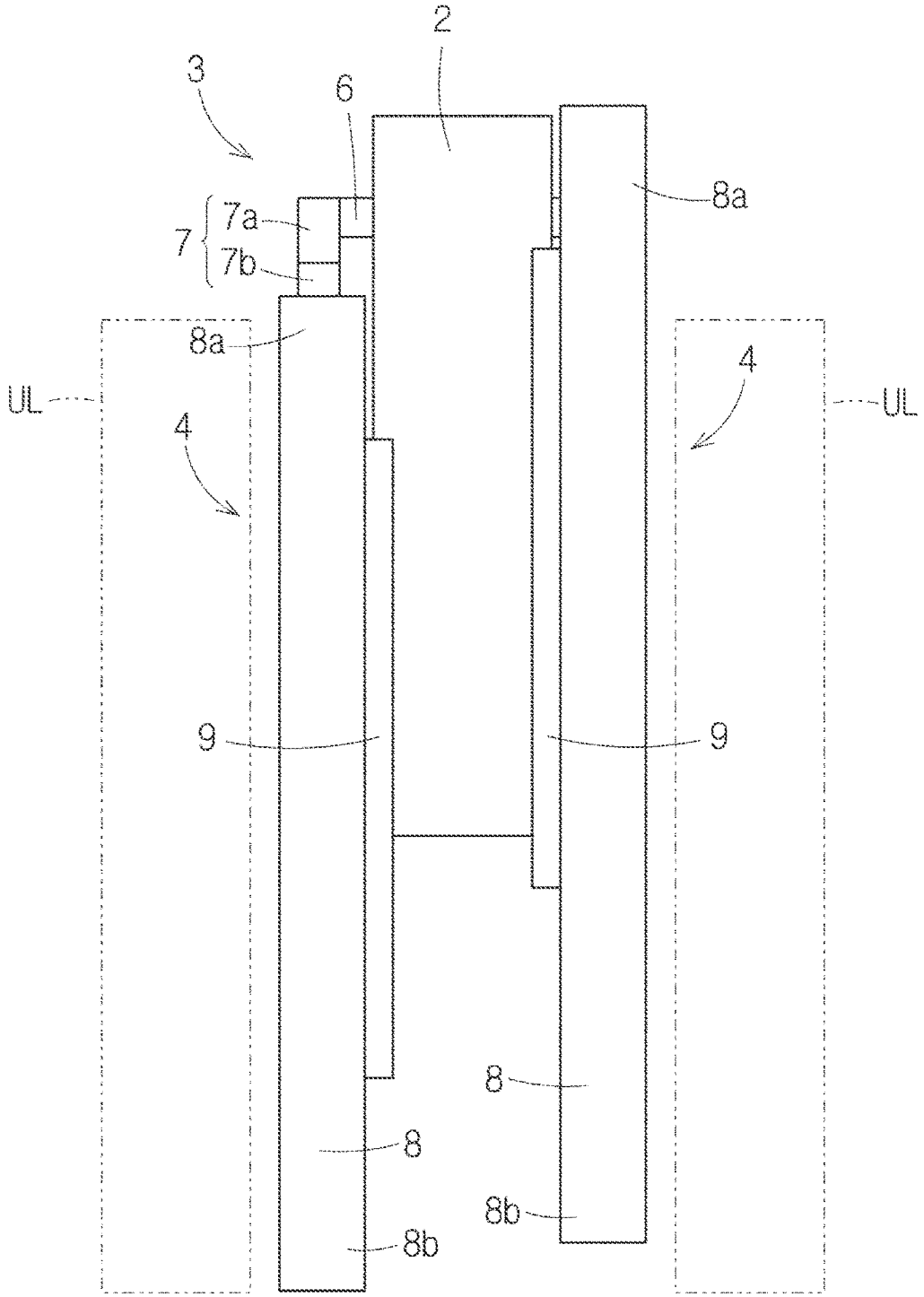
FIG. 24 is a plan view of the pedal-driven exercise machine that is out of use (fourth embodiment)

According to the foregoing configuration, when the length direction of the cranks 7 is parallel to the longitudinal direction as shown in FIG. 23, the two pedal units 4 can be pulled up inward as shown in FIG. 24, by rotating the second crank portions 7*b* with respect to the first crank portions 7*a* respectively. That is, the two pedal units 4 can be pulled up toward the main body portion 2. Thus, the foot spaces UL are secured outside the two pedal units 4 respectively. Accordingly, the pedal-driven exercise machine 1 that does not cause an obstruction when out of use is realized.

Figure 25:
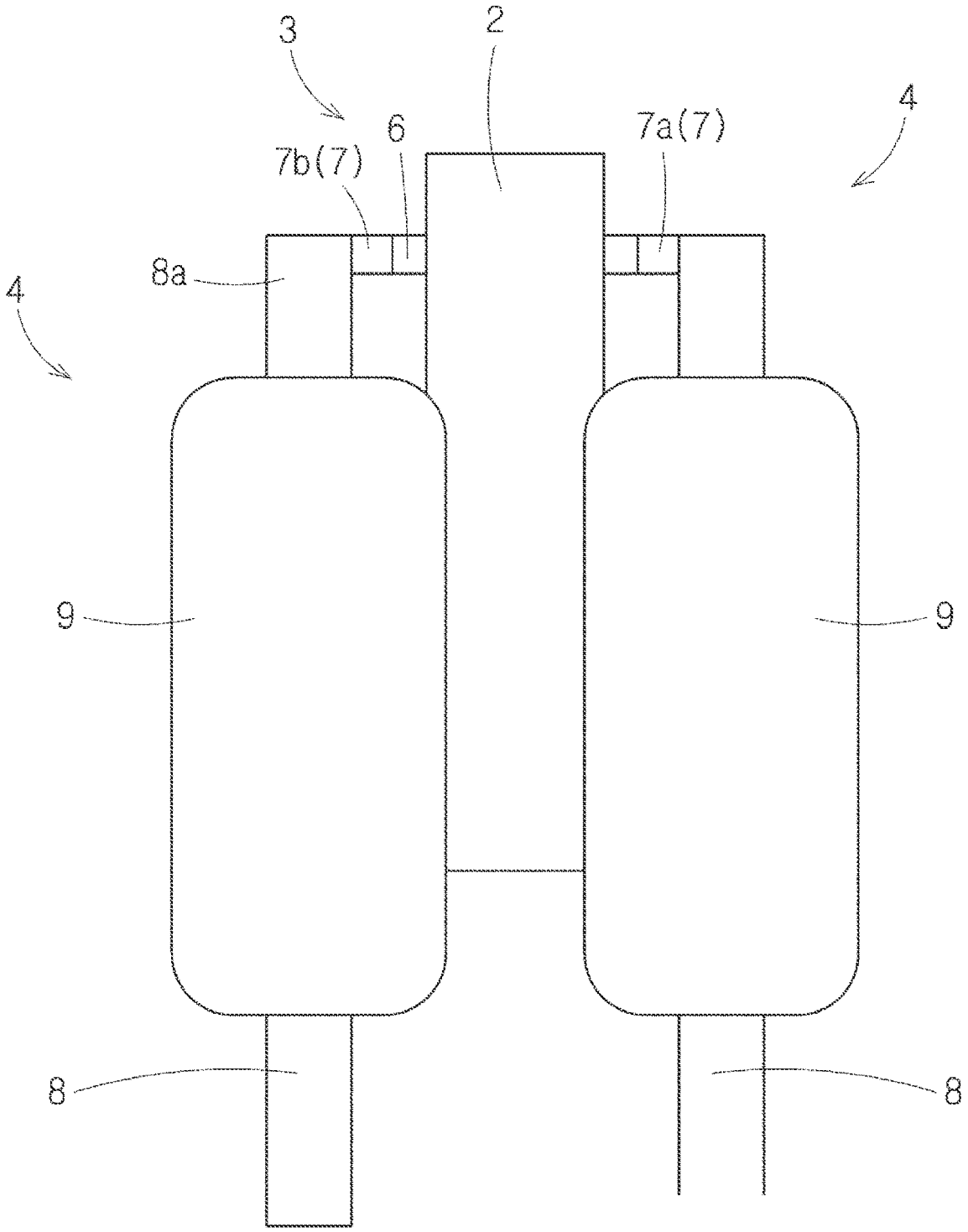
FIG. 25 is another plan view of the pedal-driven exercise machine that is in use (fourth embodiment)
Figure 26:
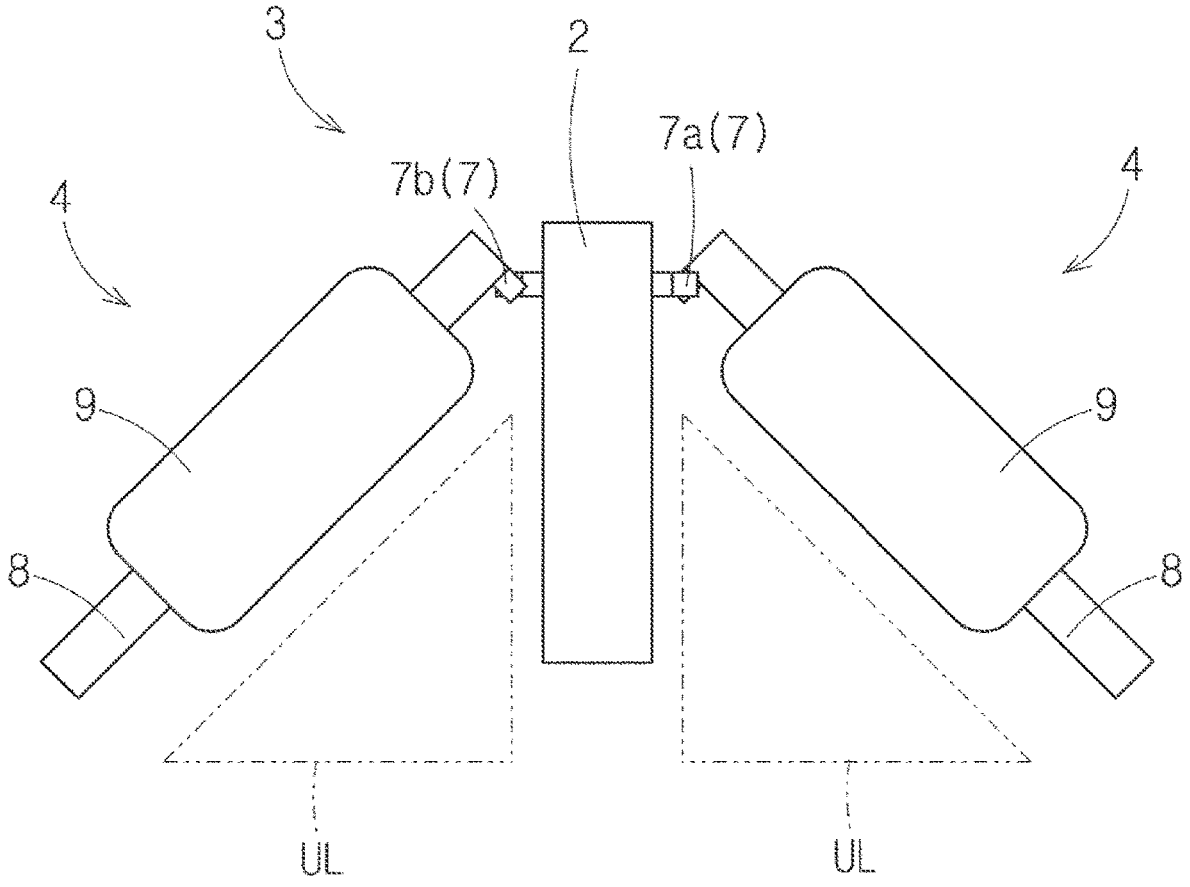
FIG. 26 is another plan view of the pedal-driven exercise machine that is out of use (fourth embodiment).

Besides, when the length direction of the cranks 7 is parallel to the vertical direction as shown in FIG. 25, the two pedal units 4 can be moved away from the main body portion 2 as shown in FIG. 26, by rotating the second crank portions 7*b* with respect to the first crank portions 7*a* respectively. Thus, the foot spaces UL are secured between the main body portion 2 and the two pedal units 4 respectively. Accordingly, the pedal-driven exercise machine 1 that does not cause an obstruction when out of use is realized.

What is claimed is:

1. A pedal-driven exercise machine designed for an exerciser in a seated position to do pedaling, the pedal-driven exercise machine comprising:

a main body portion;

a crank unit that is rotatably supported by the main body portion;

a pedal unit that is rotatably supported by the crank unit; and a foot space securer configured to secure a space at a foot of the exerciser by retreating the pedal unit from the foot of the exerciser when the pedal-driven exercise machine is out of use, wherein:

the pedal unit has a toe-side region and a heel-side region that are different in positions from each other in a foot length direction, the toe-side region is located closer to a toe side than the heel-side region in the foot length direction, the toe-side region of the pedal unit is coupled to the crank unit, and the foot space securer includes a guide that prescribes a trajectory of the heel-side region when the pedal-driven exercise machine is in use, a guide supporter that supports the guide in such a manner as to allow a position of the guide to be changed over between a first guide position that is a position in which the guide is tilted toward an exerciser side for use of the pedal-driven exercise machine, and a second guide position that is a position in which the guide has been pulled up when the pedal-driven exercise machine is out of use, and an out-of-use guide holder that holds the guide in the second guide position.

2. The pedal-driven exercise machine according to claim 1, wherein the guide supporter supports the guide rotatably around a guide rotary shaft fixed in position with respect to the main body portion.

3. The pedal-driven exercise machine according to claim 2, wherein the out-of-use guide holder holds the guide in the second guide position by imparting frictional resistance to rotation of the guide.

4. The pedal-driven exercise machine according to claim 3, wherein the foot space securer includes a torque-resistance hinge with two blades one of which is fixed to the guide and another of which is fixed in position with respect to the main body portion, and the guide supporter and the out-of-use guide holder are the two blades respectively.

5. The pedal-driven exercise machine according to claim 2, wherein the foot space securer includes a stay that is placed to bridge a gap between the guide and a member fixed in position with respect to the main body portion, at a position away from the guide rotary shaft, and the stay is the out-of-use guide holder.

6. The pedal-driven exercise machine according to claim 1, wherein the guide supporter is an elastic plate that includes an upper plate that functions as the guide, and a lower plate fixed in position with respect to the main body portion, and the upper plate and the lower plate are coupled to each other via a fold.

7. The pedal-driven exercise machine according to claim 6, wherein the elastic plate holds the guide in the second guide position by an elastic restoring force of the elastic plate along the fold, and the elastic restoring force is the out-of-use guide holder.

8. The pedal-driven exercise machine according to claim 6, wherein the foot space securer further includes an in-use guide holder that holds the guide in the first guide position.

9. The pedal-driven exercise machine according to claim 1, wherein the foot space securer includes a changeover switch that changes over the position of the guide between the first guide position and the second guide position.

10. The pedal-driven exercise machine according to claim 9, wherein the changeover switch includes a motor.

11. The pedal-driven exercise machine according to claim 1, wherein the foot space securer further includes an elastic body that pushes up the guide.

12. The pedal-driven exercise machine according to claim 1, wherein the foot space securer further includes a separation prohibition mechanism that prohibits the heel-side region from separating from the guide.

13. The pedal-driven exercise machine according to claim 1, wherein the foot space securer further includes a pull-up restrictor that prohibits the guide from being pulled up any further when the guide is in the second guide position.

14. The pedal-driven exercise machine according to claim 1, wherein the guide is provided with a handle.

15. The pedal-driven exercise machine according to claim 1, wherein the pedal unit comprises a pair of pedal units, the foot space securer comprises a pair of foot space securers, and the pair of foot space securers correspond to the pair of pedal units respectively.

16. The pedal-driven exercise machine according to claim 15, wherein the guide of each of the foot space securers is provided with a handle.

17. The pedal-driven exercise machine according to claim 15, wherein the guides of the foot space securers are formed integrally with each other.

* * * * *